US007832731B2

(12) United States Patent
Smith et al.

(10) Patent No.: US 7,832,731 B2
(45) Date of Patent: Nov. 16, 2010

(54) THREE-CARD GAME WITHOUT POKER RANKING

(76) Inventors: Ray Smith, 546 E. Curtis St., Linden, NJ (US) 07036; Amanda Tears Smith, 546 E. Curtis St., Linden, NJ (US) 07036

( * ) Notice: Subject to any disclaimer, the term of this patent is extended or adjusted under 35 U.S.C. 154(b) by 406 days.

(21) Appl. No.: 11/653,750

(22) Filed: Jan. 16, 2007

(65) Prior Publication Data

US 2008/0169606 A1 Jul. 17, 2008

(51) Int. Cl.
*A63F 9/20* (2006.01)

(52) U.S. Cl. ..... 273/292; 463/12; 463/13; 463/26; 463/27; 463/28

(58) Field of Classification Search ..... 273/292; 463/12, 13, 26, 27, 28
See application file for complete search history.

(56) References Cited

U.S. PATENT DOCUMENTS

| | | | | |
|---|---|---|---|---|
| 5,072,946 | A * | 12/1991 | Miller | 273/292 |
| 5,324,041 | A * | 6/1994 | Boylan et al. | 273/292 |
| 5,685,774 | A | 11/1997 | Webb et al. | 463/13 |
| 5,984,310 | A * | 11/1999 | English | 273/292 |
| 6,056,641 | A | 5/2000 | Webb et al. | 463/13 |
| 6,237,916 | B1 * | 5/2001 | Webb | 273/292 |
| 6,345,823 | B1 | 2/2002 | Webb et al. | 273/292 |
| 6,585,588 | B2 * | 7/2003 | Hartl | 463/16 |
| 6,698,759 | B2 | 3/2004 | Webb et al. | 273/292 |
| 7,093,833 | B1 * | 8/2006 | Horning | 273/274 |
| 7,168,705 | B2 * | 1/2007 | Schibetta | 273/292 |

(Continued)

OTHER PUBLICATIONS www.pagat.com/war/war.html, John McLeod, 1999, "War", "War for two players", Scenario 1.*

*Primary Examiner*—Alvin A Hunter
*Assistant Examiner*—Joseph B Baldori
(74) *Attorney, Agent, or Firm*—Mark A. Litman & Associates

(57) ABSTRACT

A method of playing a wagering game has at least one player placing an Ante wager to compete against a dealer in a playing card game; the at least one player receiving a player initial hand of multiple playing cards of number n and evaluating the playing cards according to rules comprising:

a) the player having the option of retaining all cards in the player initial hand or replacing one or more cards in the player initial hand if at least one card in the player initial hand equals or exceeds the minimum value to form a player resulting hand;

b) the dealer receiving a dealer initial hand having more than n cards, the dealer optionally replacing one or more cards in the dealer initial hand; and c) the dealer comparing a single highest value card in the resulting dealer hand with a single highest value card in the player resulting hand as an at least initial step in determining a win loss event for the Ante wager.

The dealer receives a dealer initial hand having more than n cards, the dealer replacing one or more cards in the dealer initial hand if at least one card in the dealer initial hand equals or exceeds the minimum value to form a dealer resulting hand; and the dealer comparing a single highest value card in the resulting dealer hand with a single highest value card in the player resulting hand as an at least initial step in determining a win loss event for the Ante wager.

20 Claims, 2 Drawing Sheets

U.S. PATENT DOCUMENTS

2003/0134670 A1* 7/2003 Kilby ..... 463/13
2004/0183256 A1* 9/2004 Ko ..... 273/292
2006/0027967 A1* 2/2006 Chen ..... 273/292
2007/0182099 A1* 8/2007 Chen et al. ..... 273/292
2007/0262528 A1* 11/2007 McKee ..... 273/293
2008/0111309 A1* 5/2008 Nicely et al. ..... 273/292

* cited by examiner

THREE-CARD GAME WITHOUT POKER RANKING

BACKGROUND OF THE INVENTION

1. Field of the Invention

The present invention relates to the field of wagering games, wagering games using playing cards, wagering games using a point count system of evaluating hands, and a game played by one player's hand against a dealer's hand or banker's hand to determine winning events.

2. Background of the Art

There are essentially three types of casino card game formats that are available to players. A first format is based on poker ranks, in which individual cards and combinations of cards have ranks or strength based upon the relative probability of a hand being provided with a specific number of cards. For example, the least frequent (lowest probability) hand in a five-card poker game that is readily identifiable is the Royal Flush comprising the Ace, King, Queen, Jack and Ten of a single suit. This low probability hand is deemed the highest ranking hand because it is readily identifiable, even though the actual probability of that hand occurring is identical to the probability for specifically any other predetermined five cards, such as the 2 of clubs, 4 of diamonds, 5 of spades, 10 of diamonds and Queen of hearts. Other ranked low probability hands are Four-of-a-kind, Full House, Flush, Straight, Three-of-a-kind, Two Pair and Pair. Different numbers of cards dealt to players can be used as the hand-forming basis and the probability of different hands occurring may vary among different games and different numbers of cards, but the hands are generally referred to in terms of Poker ranks, whether 1, 2, 3, 4, 5, 6, 7 or more cards are used. Casino war is a one-card poker game variant, for example.

A second format of game is based on the count or point value of individual cards and the collective value of points counted in hands, usually played against a dealer or banker. The most common games using point count systems are blackjack (twenty-one) and baccarat. In blackjack, the value of cards are based on their numerical value shown, with face cards (Jack, Queen and King) counting as 10 value or point cards and Aces being 1 or 11 at the option of the card holder. In baccarat, cards again have their face values, but Aces are always a value of 1 and face cards are always valued at 0 (zero) points.

A third format of casino table games is fairly rare and is often found as a side bet event, where cards are matched in suit, rank or suit and rank to establish winning events. Some games combine these games with side bet wagers in blackjack or baccarat hands that player's cards and/or dealer's cards alone or in combination can provide poker ranks of high rank out of specific combinations or total combinations of cards in the hands. Alternatively, in the play of Casino War™ games, wagers may be placed on the total point count of the players initial card, the sum of the player's and dealer's initial cards, and the like.

SUMMARY OF THE INVENTION

A playing card game is played between a player making an Ante wager and a dealer/banker. Player hands and dealer/banker hands are compared on the basis of total point counts. Pairs in hands may remove the cards in the pairs from any contribution to the total point count, so that pairs are disadvantageous. Certain side bets may also be made in the play of the game. The game is preferably played with three cards initially dealt to the player and 5 cards to the dealer/banker. There are mandatory discard and replacement events for the player's hand. The dealer's/banker's hand will play with the cards they are dealt.

BRIEF DESCRIPTION OF THE INVENTION

DETAILED DESCRIPTION OF THE INVENTION

Figure 1:
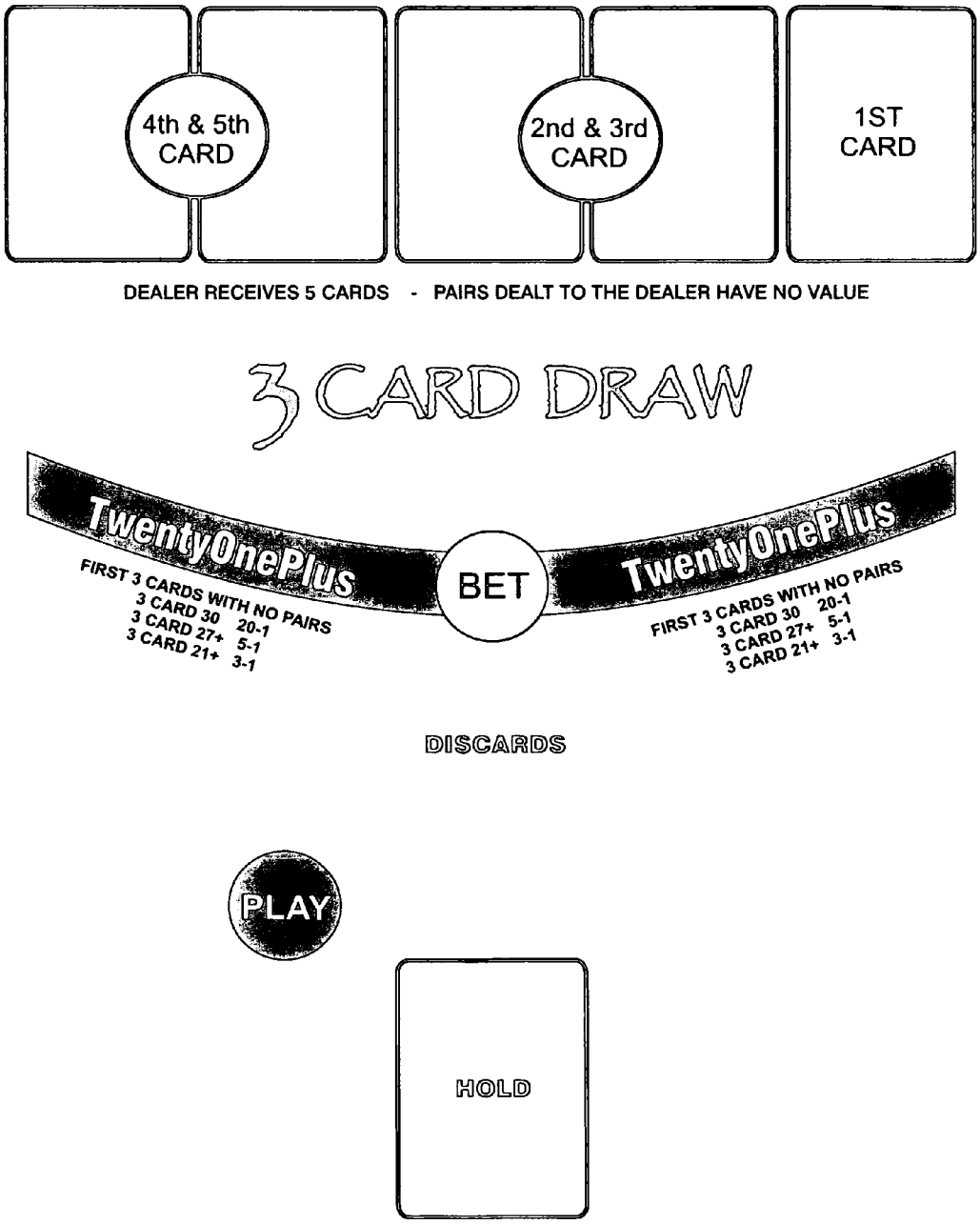
FIG. 1 shows a table layout for one variant of a game according to the present teachings.
Figure 2:
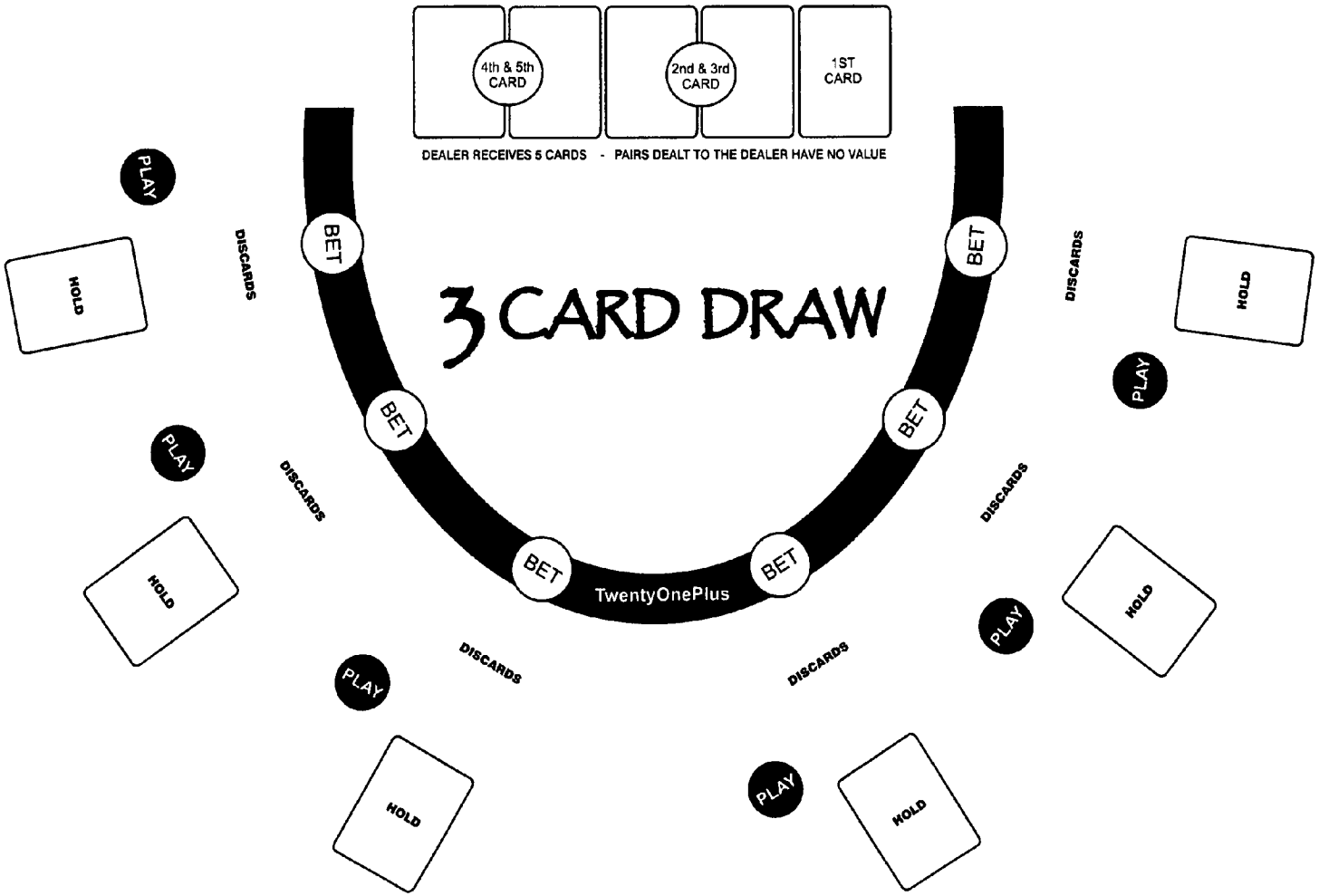
FIG. 2 shows a table layout for a single player's position for one variant of a game according to the present teachings.

The preferred game described herein within the generic scope of the game play and rules and events disclosed in this document is referred to as Three-Card Draw™ non-poker game, or 3 Card Draw™ game for short. 3 Card Draw™ game is a card game played against the dealer using a standard 52-card deck or a deck with one or more jokers or specialty cards. The winning events in the play of the game include creating a 3-card hand that contains "high cards" and no pairs. A high card is defined as any 10, Jack, Queen, or King. In 3 Card Draw™ games, suits are irrelevant and individual cards are scored at face value, with Aces being the lowest card (e.g., with a score or count of 1) and Kings, the highest card (with a score or count of 13). When a hand contains a pair, the pair of cards are ignored and effectively removed from the scoring of that hand.

General Rules of Play of a Preferred Variant of Three-Card Draw™ Games

At the start of each round, players make a single wager (e.g., an Ante wager) for the ultimate result of their 3-card hand. They may also place a wager on an optional 21+ (or Twenty-One Plus™ bet) side bet (described later herein). The dealer then deals 3 cards to each player, face down. The dealer (or banker in a player-banked game) also deals himself 5 cards face down. Players then examine their cards and determine how they wish to proceed with their hand. Players have the following playing options:

a) If a player has a dealt qualifying hand, he may choose to keep all 3 original cards or discard up to 2 cards. A dealt qualifying hand is one that contains no pairs and has at least 2 high cards and a third card that is 7 or higher. For instance, 7-J-Q and J-Q-K are both dealt qualifying hands, while 6-10-K is not a dealt qualifying hand.

b) If a player does not have a dealt qualifying hand, he must discard 1 or 2 of his cards, choosing those cards that prevent the hand from being a dealt qualifying hand.

c) The dealer then deals replacement cards (in at least an equal number to those discarded, and in one game option, with an additional card, providing the player with four cards from which to select a three card hand) to all players who did not keep all of their original cards.

d) The dealer will then reveal his 5 playing cards. The dealer will eliminate any pairs in the dealer hand (which has a higher probability of occurring than in the player's three card hands) and take the best 3 cards as his final hand.

e) The dealer will also repeat this elimination process with each player's hand. In certain cases, the dealer and/or the player will end up with a 1-card hand.

f) The dealer will then compare the dealer hand to each player's hand. When comparing 2 hands, the hand with the higher high card wins. If both hands have the same high card, the hand with the higher middle card wins. If both hands have the same high and middle cards, the hand with the higher low card wins. If both hands are exactly equal, then the hands tie. When one or more hands have been reduced to just 1 card, in each such hand the single card will act as the high card. When a 3-card hand has the same high card as a 1-card hand, the 3-card hand wins. For example, a 2-3-King beats a single King, or a single King would beat a 3-card hand if the King is the highest card. For example, a single King would beat a 3-card hand of Queen-3-2. After comparing the dealer hand to a player's hand, the dealer will resolve that player's wager as follows:
   i. If the player's hand is 9-high or lower, the player automatically loses his wager.
   ii. If the player's hand is 10-high or better, the player will compare his hand to the dealer's hand.
   iii. If the player's hand beats the dealer's hand according to the high card rules given above, the player wins even money on his wager.
   iv. If the dealer's hand beats the player's hand, the player loses his wager.
   v. In case of a tie, the player's wager is a push.

The statistical and analytical results that follow are based on the first hand dealt from a shuffled deck. To analyze 3 Card Draw, a combinatorial program was created in Java to analyze all possible ways for a player to play his hand. The following is an outline of the steps that the program executed.

1. Cycle through all 22,100 ways to deal 3 cards to a player from a single deck.
2. For each set of 3 cards, cycle through all possible ways for the player to play that hand.
3. For each of the situations in step 2, cycle through all possible replacement cards for the player's discards, if any.
4. For each set of final 3 cards in step 3, cycle through all ways to deal the dealer's 5 hole cards from the remaining deck.
5. For each set of the dealer's 5 hole cards, determine what the dealer's best final dealt 3-card hand is based on the original 5 cards. Compare this best 3-Card hand with the player's hand and determine if the player won, tied, or lost. Keep a running tally of the results.
6. Using the results from step 5, calculate the expected values[1] (EV) of each way to play the dealt hand. Take the highest of these values, ignoring the EV of holding all 3 original cards if the player did not have a dealt qualifying hand.

[1] The expected value is defined as the weighted average of all possible outcomes of an event. Suppose there are n possible outcomes of an event. Let $x_i$=value of the ith outcome and $p_i$=the probability the ith outcome. The expected value=$\Sigma x_i * p_i$, for i=1, 2, . . . , n.

7. Find the average of the highest EV's from step 7. This is the expectation of a single wager in the game. The negative of this figure is the house advantage.

The following table summarizes these results. See Appendix A for complete analysis details and the optimal playing strategy.

TABLE 1

House advantage summary.

| Event | Pays | Probability | Frequency | Return |
|---|---|---|---|---|
| Final Hand 9 High or Less | −1 | 0.189800 | 1 in 5.3 | −0.189800 |
| Wins | 1 | 0.491046 | 1 in 2.0 | 0.491046 |
| Ties | 0 | 0.002592 | 1 in 385.8 | 0.000000 |
| Losses | −1 | 0.316562 | 1 in 3.2 | −0.316562 |
| Total | | 1.000000 | | −0.015316 |
| | | | House Advantage | 1.5316% |

21+ Side Bet—Rules/Analysis

The 21+ bet is a side bet that pays for certain combinations of the player's first 3 cards. To win, a player needs 3 dealt cards that contain at least 2 high cards and no pairs. The following table shows the different hands on the pay schedule and the house advantage of the bet.

TABLE 2

21 + side bet house advantage summary.

| Hand | Pays | Combinations | Probability | Frequency | Return |
|---|---|---|---|---|---|
| Three (Non-pairing) High Cards | 20 to 1 | 256 | 0.011584 | 1 in 86.3 | 0.231674 |
| Two High (Non-Pairing) Cards + 7, 8 or 9 | 5 | 1152 | 0.052127 | 1 in 19.2 | 0.260633 |
| Two High Cards + A, 2, 3, 4 5, or 6 | 3 | 2304 | 0.104253 | 1 in 9.6 | 0.312760 |
| Other | −1 | 18,388 | 0.832036 | 1 in 1.2 | −0.832036 |
| Total | | 22,100 | 1.000000 | | −0.026968 |
| | | | | House Advantage | 2.6968% |

Appendix A

The following table gives the expected values of all ways to play any dealt hand and shows the optimal playing strategy. Note: Although the table shows the value of keeping all 3 original cards for all hands, in most cases, this is not a valid option.

TABLE 3

Expected values of all ways to play all hands and optimal playing strategy.

| Hand | Optimal Holds | Discard 1st | Discard 2nd | Discard 3rd | Keep 1st | Keep 2nd | Keep 3rd | Keep All | Best EV | Probability | Return |
|---|---|---|---|---|---|---|---|---|---|---|---|
| K K K | K | −0.7333 | −0.7333 | −0.7333 | 0.7944 | 0.7944 | 0.7944 | 0.7972 | 0.7944 | 0.0002 | 0.0001 |
| K K Q | K Q | 0.8935 | 0.8935 | −0.7322 | 0.6225 | 0.6225 | 0.2397 | 0.1980 | 0.8935 | 0.0011 | 0.0010 |
| K K J | K J | 0.8046 | 0.8046 | −0.7319 | 0.6226 | 0.6226 | −0.0315 | −0.2018 | 0.8046 | 0.0011 | 0.0009 |
| K K 10 | K 10 | 0.7432 | 0.7432 | −0.7316 | 0.6227 | 0.6227 | −0.1955 | −0.4781 | 0.7432 | 0.0011 | 0.0008 |
| K K 9 | K 9 | 0.6869 | 0.6869 | −0.7246 | 0.6234 | 0.6234 | −0.4500 | −1.0000 | 0.6869 | 0.0011 | 0.0007 |
| K K 8 | K 8 | 0.6651 | 0.6651 | −0.7246 | 0.6234 | 0.6234 | −0.4670 | −1.0000 | 0.6651 | 0.0011 | 0.0007 |
| K K 7 | K 7 | 0.6510 | 0.6510 | −0.7246 | 0.6234 | 0.6234 | −0.4778 | −1.0000 | 0.6510 | 0.0011 | 0.0007 |
| K K 6 | K 6 | 0.6420 | 0.6420 | −0.7246 | 0.6235 | 0.6235 | −0.4845 | −1.0000 | 0.6420 | 0.0011 | 0.0007 |
| K K 5 | K 5 | 0.6363 | 0.6363 | −0.7246 | 0.6235 | 0.6235 | −0.4886 | −1.0000 | 0.6363 | 0.0011 | 0.0007 |
| K K 4 | K 4 | 0.6328 | 0.6328 | −0.7246 | 0.6235 | 0.6235 | −0.4911 | −1.0000 | 0.6328 | 0.0011 | 0.0007 |
| K K 3 | K 3 | 0.6306 | 0.6306 | −0.7246 | 0.6235 | 0.6235 | −0.4926 | −1.0000 | 0.6306 | 0.0011 | 0.0007 |
| K K 2 | K 2 | 0.6291 | 0.6291 | −0.7246 | 0.6235 | 0.6235 | −0.4936 | −1.0000 | 0.6291 | 0.0011 | 0.0007 |
| K K A | K A | 0.6278 | 0.6278 | −0.7246 | 0.6235 | 0.6235 | −0.4944 | −1.0000 | 0.6278 | 0.0011 | 0.0007 |
| K Q Q | K Q | −0.7321 | 0.8806 | 0.8806 | 0.4790 | 0.2667 | 0.2667 | 0.4887 | 0.8806 | 0.0011 | 0.0010 |
| K Q J | K Q J | 0.3894 | 0.7424 | 0.8424 | 0.4788 | 0.1672 | −0.0435 | 0.9889 | 0.9889 | 0.0029 | 0.0029 |
| K Q 10 | K Q 10 | 0.2999 | 0.6529 | 0.8424 | 0.4789 | 0.1674 | −0.2037 | 0.9629 | 0.9629 | 0.0029 | 0.0028 |
| K Q 9 | K Q 9 | 0.2182 | 0.5712 | 0.8425 | 0.4799 | 0.1684 | −0.4524 | 0.9420 | 0.9420 | 0.0029 | 0.0027 |
| K Q 8 | K Q 8 | 0.1868 | 0.5398 | 0.8425 | 0.4800 | 0.1684 | −0.4685 | 0.9255 | 0.9255 | 0.0029 | 0.0027 |
| K Q 7 | K Q 7 | 0.1667 | 0.5197 | 0.8426 | 0.4800 | 0.1685 | −0.4786 | 0.9129 | 0.9129 | 0.0029 | 0.0026 |
| K Q 6 | K Q | 0.1539 | 0.5069 | 0.8426 | 0.4801 | 0.1685 | −0.4849 | 0.9035 | 0.8426 | 0.0029 | 0.0024 |
| K Q 5 | K Q | 0.1460 | 0.4990 | 0.8426 | 0.4801 | 0.1685 | −0.4888 | 0.8967 | 0.8426 | 0.0029 | 0.0024 |
| K Q 4 | K Q | 0.1410 | 0.4940 | 0.8426 | 0.4801 | 0.1686 | −0.4912 | 0.8920 | 0.8426 | 0.0029 | 0.0024 |
| K Q 3 | K Q | 0.1380 | 0.4910 | 0.8426 | 0.4801 | 0.1686 | −0.4926 | 0.8888 | 0.8426 | 0.0029 | 0.0024 |
| K Q 2 | K Q | 0.1360 | 0.4890 | 0.8427 | 0.4802 | 0.1686 | −0.4935 | 0.8863 | 0.8427 | 0.0029 | 0.0024 |
| K Q A | K Q | 0.1342 | 0.4872 | 0.8427 | 0.4802 | 0.1686 | −0.4943 | 0.8841 | 0.8427 | 0.0029 | 0.0024 |
| K J J | K J | −0.7318 | 0.7481 | 0.7481 | 0.4792 | −0.0127 | −0.0127 | 0.4887 | 0.7481 | 0.0011 | 0.0008 |
| K J 10 | K J 10 | 0.0017 | 0.6529 | 0.7219 | 0.4790 | −0.0751 | −0.2032 | 0.8458 | 0.8458 | 0.0029 | 0.0024 |
| K J 9 | K J 9 | −0.0800 | 0.5712 | 0.7219 | 0.4800 | −0.0741 | −0.4519 | 0.8248 | 0.8248 | 0.0029 | 0.0024 |
| K J 8 | K J 8 | −0.1113 | 0.5399 | 0.7220 | 0.4801 | −0.0740 | −0.4680 | 0.8084 | 0.8084 | 0.0029 | 0.0023 |
| K J 7 | K J 7 | −0.1315 | 0.5197 | 0.7220 | 0.4801 | −0.0740 | −0.4781 | 0.7957 | 0.7957 | 0.0029 | 0.0023 |
| K J 6 | K J | −0.1442 | 0.5070 | 0.7221 | 0.4802 | −0.0739 | −0.4844 | 0.7863 | 0.7221 | 0.0029 | 0.0021 |
| K J 5 | K J | −0.1522 | 0.4990 | 0.7221 | 0.4802 | −0.0739 | −0.4883 | 0.7796 | 0.7221 | 0.0029 | 0.0021 |
| K J 4 | K J | −0.1571 | 0.4941 | 0.7221 | 0.4802 | −0.0739 | −0.4907 | 0.7749 | 0.7221 | 0.0029 | 0.0021 |
| K J 3 | K J | −0.1602 | 0.4911 | 0.7221 | 0.4803 | −0.0738 | −0.4921 | 0.7716 | 0.7221 | 0.0029 | 0.0021 |
| K J 2 | K J | −0.1621 | 0.4891 | 0.7221 | 0.4803 | −0.0738 | −0.4930 | 0.7692 | 0.7221 | 0.0029 | 0.0021 |
| K J A | K J | −0.1640 | 0.4872 | 0.7221 | 0.4803 | −0.0738 | −0.4938 | 0.7670 | 0.7221 | 0.0029 | 0.0021 |
| K 10 10 | K 10 | −0.7316 | 0.6570 | 0.6570 | 0.4793 | −0.1823 | −0.1823 | 0.4887 | 0.6570 | 0.0011 | 0.0007 |
| K 10 9 | K 10 9 | −0.2710 | 0.5712 | 0.6394 | 0.4801 | −0.2203 | −0.4516 | 0.7379 | 0.7379 | 0.0029 | 0.0021 |
| K 10 8 | K 10 8 | −0.3024 | 0.5399 | 0.6395 | 0.4802 | −0.2203 | −0.4676 | 0.7214 | 0.7214 | 0.0029 | 0.0021 |
| K 10 7 | K 10 7 | −0.3225 | 0.5198 | 0.6395 | 0.4802 | −0.2202 | −0.4778 | 0.7088 | 0.7088 | 0.0029 | 0.0021 |
| K 10 6 | K 10 | −0.3353 | 0.5070 | 0.6395 | 0.4803 | −0.2202 | −0.4841 | 0.6994 | 0.6395 | 0.0029 | 0.0019 |
| K 10 5 | K 10 | −0.3432 | 0.4991 | 0.6396 | 0.4803 | −0.2201 | −0.4879 | 0.6927 | 0.6396 | 0.0029 | 0.0019 |
| K 10 4 | K 10 | −0.3481 | 0.4941 | 0.6396 | 0.4803 | −0.2201 | −0.4903 | 0.6880 | 0.6396 | 0.0029 | 0.0019 |
| K 10 3 | K 10 | −0.3512 | 0.4911 | 0.6396 | 0.4804 | −0.2201 | −0.4917 | 0.6847 | 0.6396 | 0.0029 | 0.0019 |
| K 10 2 | K 10 | −0.3532 | 0.4891 | 0.6396 | 0.4804 | −0.2201 | −0.4926 | 0.6822 | 0.6396 | 0.0029 | 0.0019 |
| K 10 A | K 10 | −0.3550 | 0.4873 | 0.6396 | 0.4804 | −0.2200 | −0.4935 | 0.6800 | 0.6396 | 0.0029 | 0.0019 |
| K 9 9 | K 9 | −0.7174 | 0.5736 | 0.5736 | 0.4812 | −0.4346 | −0.4346 | 0.4887 | 0.5736 | 0.0011 | 0.0006 |
| K 9 8 | K 9 | −0.6647 | 0.5400 | 0.5644 | 0.4811 | −0.4403 | −0.4547 | 0.6585 | 0.5644 | 0.0029 | 0.0016 |
| K 9 7 | K 9 | −0.6687 | 0.5198 | 0.5644 | 0.4812 | −0.4402 | −0.4662 | 0.6458 | 0.5644 | 0.0029 | 0.0016 |
| K 9 6 | K 9 | −0.6717 | 0.5071 | 0.5645 | 0.4812 | −0.4402 | −0.4734 | 0.6365 | 0.5645 | 0.0029 | 0.0016 |
| K 9 5 | K 9 | −0.6738 | 0.4991 | 0.5645 | 0.4812 | −0.4402 | −0.4778 | 0.6297 | 0.5645 | 0.0029 | 0.0016 |
| K 9 4 | K 9 | −0.6753 | 0.4942 | 0.5645 | 0.4813 | −0.4402 | −0.4804 | 0.6250 | 0.5645 | 0.0029 | 0.0016 |
| K 9 3 | K 9 | −0.6763 | 0.4911 | 0.5645 | 0.4813 | −0.4402 | −0.4820 | 0.6217 | 0.5645 | 0.0029 | 0.0016 |
| K 9 2 | K 9 | −0.6770 | 0.4891 | 0.5645 | 0.4813 | −0.4402 | −0.4830 | 0.6193 | 0.5645 | 0.0029 | 0.0016 |
| K 9 A | K 9 | −0.6777 | 0.4873 | 0.5645 | 0.4813 | −0.4402 | −0.4839 | 0.6171 | 0.5645 | 0.0029 | 0.0016 |
| K 8 8 | K 8 | −0.7174 | 0.5415 | 0.5415 | 0.4813 | −0.4535 | −0.4535 | 0.4887 | 0.5415 | 0.0011 | 0.0006 |
| K 8 7 | K 8 | −0.6826 | 0.5198 | 0.5357 | 0.4812 | −0.4571 | −0.4662 | 0.6014 | 0.5357 | 0.0029 | 0.0016 |
| K 8 6 | K 8 | −0.6855 | 0.5071 | 0.5357 | 0.4813 | −0.4570 | −0.4734 | 0.5921 | 0.5357 | 0.0029 | 0.0016 |
| K 8 5 | K 8 | −0.6877 | 0.4991 | 0.5357 | 0.4813 | −0.4570 | −0.4777 | 0.5853 | 0.5357 | 0.0029 | 0.0016 |
| K 8 4 | K 8 | −0.6891 | 0.4942 | 0.5357 | 0.4813 | −0.4570 | −0.4804 | 0.5806 | 0.5357 | 0.0029 | 0.0016 |
| K 8 3 | K 8 | −0.6901 | 0.4912 | 0.5358 | 0.4813 | −0.4570 | −0.4820 | 0.5773 | 0.5358 | 0.0029 | 0.0016 |
| K 8 2 | K 8 | −0.6909 | 0.4892 | 0.5358 | 0.4814 | −0.4570 | −0.4830 | 0.5749 | 0.5358 | 0.0029 | 0.0016 |
| K 8 A | K 8 | −0.6915 | 0.4874 | 0.5358 | 0.4814 | −0.4570 | −0.4839 | 0.5727 | 0.5358 | 0.0029 | 0.0016 |
| K 7 7 | K 7 | −0.7174 | 0.5208 | 0.5208 | 0.4814 | −0.4655 | −0.4655 | 0.4887 | 0.5208 | 0.0011 | 0.0006 |
| K 7 6 | K 7 | −0.6950 | 0.5071 | 0.5172 | 0.4813 | −0.4676 | −0.4733 | 0.5616 | 0.5172 | 0.0029 | 0.0015 |
| K 7 5 | K 7 | −0.6971 | 0.4991 | 0.5172 | 0.4813 | −0.4676 | −0.4777 | 0.5548 | 0.5172 | 0.0029 | 0.0015 |
| K 7 4 | K 7 | −0.6986 | 0.4942 | 0.5172 | 0.4814 | −0.4676 | −0.4804 | 0.5501 | 0.5172 | 0.0029 | 0.0015 |
| K 7 3 | K 7 | −0.6996 | 0.4912 | 0.5173 | 0.4814 | −0.4676 | −0.4820 | 0.5468 | 0.5173 | 0.0029 | 0.0015 |
| K 7 2 | K 7 | −0.7003 | 0.4892 | 0.5173 | 0.4814 | −0.4676 | −0.4830 | 0.5444 | 0.5173 | 0.0029 | 0.0015 |
| K 7 A | K 7 | −0.7010 | 0.4874 | 0.5173 | 0.4814 | −0.4676 | −0.4839 | 0.5422 | 0.5173 | 0.0029 | 0.0015 |
| K 6 6 | K 6 | −0.7174 | 0.5077 | 0.5077 | 0.4814 | −0.4729 | −0.4729 | 0.4887 | 0.5077 | 0.0011 | 0.0006 |
| K 6 5 | K 6 | −0.7034 | 0.4992 | 0.5055 | 0.4814 | −0.4742 | −0.4777 | 0.5344 | 0.5055 | 0.0029 | 0.0015 |
| K 6 4 | K 6 | −0.7049 | 0.4942 | 0.5055 | 0.4814 | −0.4742 | −0.4804 | 0.5297 | 0.5055 | 0.0029 | 0.0015 |
| K 6 3 | K 6 | −0.7059 | 0.4912 | 0.5056 | 0.4814 | −0.4742 | −0.4819 | 0.5264 | 0.5056 | 0.0029 | 0.0015 |

TABLE 3-continued

Expected values of all ways to play all hands and optimal playing strategy.

| Hand | Optimal Holds | Discard 1st | Discard 2nd | Discard 3rd | Keep 1st | Keep 2nd | Keep 3rd | Keep All | Best EV | Probability | Return |
|---|---|---|---|---|---|---|---|---|---|---|---|
| K 6 2 | K 6 | −0.7066 | 0.4892 | 0.5056 | 0.4815 | −0.4742 | −0.4830 | 0.5240 | 0.5056 | 0.0029 | 0.0015 |
| K 6 A | K 6 | −0.7073 | 0.4874 | 0.5056 | 0.4815 | −0.4742 | −0.4839 | 0.5218 | 0.5056 | 0.0029 | 0.0015 |
| K 5 5 | K 5 | −0.7174 | 0.4995 | 0.4995 | 0.4815 | −0.4775 | −0.4775 | 0.4887 | 0.4995 | 0.0011 | 0.0005 |
| K 5 4 | K 5 | −0.7090 | 0.4943 | 0.4982 | 0.4815 | −0.4782 | −0.4803 | 0.5164 | 0.4982 | 0.0029 | 0.0014 |
| K 5 3 | K 5 | −0.7100 | 0.4912 | 0.4982 | 0.4815 | −0.4782 | −0.4819 | 0.5131 | 0.4982 | 0.0029 | 0.0014 |
| K 5 2 | K 5 | −0.7107 | 0.4892 | 0.4982 | 0.4815 | −0.4782 | −0.4830 | 0.5106 | 0.4982 | 0.0029 | 0.0014 |
| K 5 A | K 5 | −0.7114 | 0.4874 | 0.4982 | 0.4815 | −0.4782 | −0.4839 | 0.5084 | 0.4982 | 0.0029 | 0.0014 |
| K 4 4 | K 4 | −0.7174 | 0.4944 | 0.4944 | 0.4815 | −0.4802 | −0.4802 | 0.4887 | 0.4944 | 0.0011 | 0.0005 |
| K 4 3 | K 4 | −0.7126 | 0.4912 | 0.4937 | 0.4815 | −0.4806 | −0.4819 | 0.5046 | 0.4937 | 0.0029 | 0.0014 |
| K 4 2 | K 4 | −0.7133 | 0.4893 | 0.4937 | 0.4815 | −0.4806 | −0.4829 | 0.5022 | 0.4937 | 0.0029 | 0.0014 |
| K 4 A | K 4 | −0.7140 | 0.4874 | 0.4937 | 0.4815 | −0.4806 | −0.4839 | 0.4999 | 0.4937 | 0.0029 | 0.0014 |
| K 3 3 | K 3 | −0.7174 | 0.4913 | 0.4913 | 0.4815 | −0.4819 | −0.4819 | 0.4887 | 0.4913 | 0.0011 | 0.0005 |
| K 3 2 | K 3 | −0.7148 | 0.4893 | 0.4909 | 0.4815 | −0.4821 | −0.4829 | 0.4971 | 0.4909 | 0.0029 | 0.0014 |
| K 3 A | K 3 | −0.7155 | 0.4874 | 0.4909 | 0.4815 | −0.4821 | −0.4839 | 0.4949 | 0.4909 | 0.0029 | 0.0014 |
| K 2 2 | K 2 | −0.7174 | 0.4893 | 0.4893 | 0.4816 | −0.4829 | −0.4829 | 0.4887 | 0.4893 | 0.0011 | 0.0005 |
| K 2 A | K 2 | −0.7162 | 0.4874 | 0.4889 | 0.4816 | −0.4831 | −0.4839 | 0.4927 | 0.4889 | 0.0029 | 0.0014 |
| K A A | K A | −0.7174 | 0.4873 | 0.4873 | 0.4816 | −0.4839 | −0.4839 | 0.4887 | 0.4873 | 0.0011 | 0.0005 |
| Q Q Q | Q | −0.7331 | −0.7331 | −0.7331 | 0.3194 | 0.3194 | 0.3194 | 0.2237 | 0.3194 | 0.0002 | 0.0001 |
| Q Q J | Q J | 0.3386 | 0.3386 | −0.7315 | 0.2094 | 0.2094 | −0.0308 | −0.2018 | 0.3386 | 0.0011 | 0.0004 |
| Q Q 10 | Q 10 | 0.2772 | 0.2772 | −0.7313 | 0.2095 | 0.2095 | −0.1949 | −0.4781 | 0.2772 | 0.0011 | 0.0003 |
| Q Q 9 | Q 9 | 0.2209 | 0.2209 | −0.7242 | 0.2101 | 0.2101 | −0.4493 | −1.0000 | 0.2209 | 0.0011 | 0.0002 |
| Q Q 8 | Q | 0.1991 | 0.1991 | −0.7242 | 0.2102 | 0.2102 | −0.4664 | −1.0000 | 0.2102 | 0.0011 | 0.0002 |
| Q Q 7 | Q | 0.1850 | 0.1850 | −0.7242 | 0.2102 | 0.2102 | −0.4771 | −1.0000 | 0.2102 | 0.0011 | 0.0002 |
| Q Q 6 | Q | 0.1760 | 0.1760 | −0.7242 | 0.2103 | 0.2103 | −0.4838 | −1.0000 | 0.2103 | 0.0011 | 0.0002 |
| Q Q 5 | Q | 0.1703 | 0.1703 | −0.7242 | 0.2103 | 0.2103 | −0.4879 | −1.0000 | 0.2103 | 0.0011 | 0.0002 |
| Q Q 4 | Q | 0.1668 | 0.1668 | −0.7242 | 0.2103 | 0.2103 | −0.4904 | −1.0000 | 0.2103 | 0.0011 | 0.0002 |
| Q Q 3 | Q | 0.1646 | 0.1646 | −0.7242 | 0.2103 | 0.2103 | −0.4919 | −1.0000 | 0.2103 | 0.0011 | 0.0002 |
| Q Q 2 | Q | 0.1632 | 0.1632 | −0.7242 | 0.2103 | 0.2103 | −0.4929 | −1.0000 | 0.2103 | 0.0011 | 0.0002 |
| Q Q A | Q | 0.1618 | 0.1618 | −0.7242 | 0.2103 | 0.2103 | −0.4938 | −1.0000 | 0.2103 | 0.0011 | 0.0002 |
| Q J J | Q J | −0.7315 | 0.3294 | 0.3294 | 0.1183 | −0.0121 | −0.0121 | 0.0047 | 0.3294 | 0.0011 | 0.0004 |
| Q J 10 | Q J 10 | 0.0020 | 0.2342 | 0.3032 | 0.1182 | −0.0745 | −0.2026 | 0.3617 | 0.3617 | 0.0029 | 0.0010 |
| Q J 9 | Q J 9 | −0.0797 | 0.1525 | 0.3033 | 0.1192 | −0.0735 | −0.4513 | 0.3408 | 0.3408 | 0.0029 | 0.0010 |
| Q J 8 | Q J 8 | −0.1110 | 0.1212 | 0.3033 | 0.1192 | −0.0734 | −0.4674 | 0.3243 | 0.3243 | 0.0029 | 0.0009 |
| Q J 7 | Q J 7 | −0.1312 | 0.1010 | 0.3033 | 0.1193 | −0.0734 | −0.4775 | 0.3117 | 0.3117 | 0.0029 | 0.0009 |
| Q J 6 | Q J | −0.1439 | 0.0883 | 0.3034 | 0.1193 | −0.0733 | −0.4838 | 0.3023 | 0.3034 | 0.0029 | 0.0009 |
| Q J 5 | Q J | −0.1519 | 0.0803 | 0.3034 | 0.1193 | −0.0733 | −0.4877 | 0.2955 | 0.3034 | 0.0029 | 0.0009 |
| Q J 4 | Q J | −0.1568 | 0.0754 | 0.3034 | 0.1194 | −0.0732 | −0.4901 | 0.2908 | 0.3034 | 0.0029 | 0.0009 |
| Q J 3 | Q J | −0.1598 | 0.0724 | 0.3034 | 0.1194 | −0.0732 | −0.4915 | 0.2876 | 0.3034 | 0.0029 | 0.0009 |
| Q J 2 | Q J | −0.1618 | 0.0704 | 0.3034 | 0.1194 | −0.0732 | −0.4924 | 0.2851 | 0.3034 | 0.0029 | 0.0009 |
| Q J A | Q J | −0.1636 | 0.0686 | 0.3034 | 0.1194 | −0.0732 | −0.4932 | 0.2829 | 0.3034 | 0.0029 | 0.0009 |
| Q 10 10 | Q 10 | −0.7312 | 0.2383 | 0.2383 | 0.1184 | −0.1817 | −0.1817 | 0.0047 | 0.2383 | 0.0011 | 0.0003 |
| Q 10 9 | Q 10 9 | −0.2707 | 0.1526 | 0.2207 | 0.1193 | −0.2197 | −0.4510 | 0.2539 | 0.2539 | 0.0029 | 0.0007 |
| Q 10 8 | Q 10 8 | −0.3020 | 0.1212 | 0.2208 | 0.1193 | −0.2196 | −0.4670 | 0.2374 | 0.2374 | 0.0029 | 0.0007 |
| Q 10 7 | Q 10 7 | −0.3222 | 0.1011 | 0.2208 | 0.1194 | −0.2196 | −0.4772 | 0.2248 | 0.2248 | 0.0029 | 0.0007 |
| Q 10 6 | Q 10 | −0.3349 | 0.0883 | 0.2208 | 0.1194 | −0.2195 | −0.4835 | 0.2154 | 0.2208 | 0.0029 | 0.0006 |
| Q 10 5 | Q 10 | −0.3429 | 0.0804 | 0.2209 | 0.1195 | −0.2195 | −0.4873 | 0.2086 | 0.2209 | 0.0029 | 0.0006 |
| Q 10 4 | Q 10 | −0.3478 | 0.0754 | 0.2209 | 0.1195 | −0.2195 | −0.4897 | 0.2039 | 0.2209 | 0.0029 | 0.0006 |
| Q 10 3 | Q 10 | −0.3508 | 0.0724 | 0.2209 | 0.1195 | −0.2195 | −0.4911 | 0.2006 | 0.2209 | 0.0029 | 0.0006 |
| Q 10 2 | Q 10 | −0.3528 | 0.0704 | 0.2209 | 0.1195 | −0.2194 | −0.4920 | 0.1982 | 0.2209 | 0.0029 | 0.0006 |
| Q 10 A | Q 10 | −0.3547 | 0.0686 | 0.2209 | 0.1195 | −0.2194 | −0.4929 | 0.1960 | 0.2209 | 0.0029 | 0.0006 |
| Q 9 9 | Q 9 | −0.7170 | 0.1550 | 0.1550 | 0.1204 | −0.4339 | −0.4339 | 0.0047 | 0.1550 | 0.0011 | 0.0002 |
| Q 9 8 | Q 9 | −0.6644 | 1.1213 | 0.1457 | 0.1202 | −0.4397 | −0.4540 | 0.1744 | 0.1457 | 0.0029 | 0.0004 |
| Q 9 7 | Q 9 | −0.6684 | 0.1011 | 0.1457 | 0.1203 | −0.4396 | −0.4656 | 0.1618 | 0.1457 | 0.0029 | 0.0004 |
| Q 9 6 | Q 9 | −0.6714 | 0.0884 | 0.1458 | 0.1203 | −0.4396 | −0.4728 | 0.1524 | 0.1458 | 0.0029 | 0.0004 |
| Q 9 5 | Q 9 | −0.6735 | 0.0804 | 0.1458 | 0.1204 | −0.4396 | −0.4771 | 0.1457 | 0.1458 | 0.0029 | 0.0004 |
| Q 9 4 | Q 9 | −0.6749 | 0.0755 | 0.1458 | 0.1204 | −0.4396 | −0.4798 | 0.1410 | 0.1458 | 0.0029 | 0.0004 |
| Q 9 3 | Q 9 | −0.6760 | 0.0724 | 0.1458 | 0.1204 | −0.4396 | −0.4814 | 0.1377 | 0.1458 | 0.0029 | 0.0004 |
| Q 9 2 | Q 9 | −0.6767 | 0.0704 | 0.1458 | 0.1204 | −0.4396 | −0.4824 | 0.1352 | 0.1458 | 0.0029 | 0.0004 |
| Q 9 A | Q 9 | −0.6774 | 0.0686 | 0.1458 | 0.1204 | −0.4396 | −0.4833 | 0.1330 | 0.1458 | 0.0029 | 0.0004 |
| Q 8 8 | Q 8 | −0.7170 | 0.1228 | 0.1228 | 0.1205 | −0.4529 | −0.4529 | 0.0047 | 0.1228 | 0.0011 | 0.0001 |
| Q 8 7 | Q | −0.6823 | 0.1011 | 0.1170 | 0.1204 | −0.4565 | −0.4656 | 0.1174 | 0.1204 | 0.0029 | 0.0003 |
| Q 8 6 | Q | −0.6852 | 0.0884 | 0.1170 | 0.1204 | −0.4564 | −0.4728 | 0.1080 | 0.1204 | 0.0029 | 0.0003 |
| Q 8 5 | Q | −0.6873 | 0.0804 | 0.1170 | 0.1204 | −0.4564 | −0.4771 | 0.1013 | 0.1204 | 0.0029 | 0.0003 |
| Q 8 4 | Q | −0.6888 | 0.0755 | 0.1170 | 0.1205 | −0.4564 | −0.4798 | 0.0966 | 0.1205 | 0.0029 | 0.0003 |
| Q 8 3 | Q | −0.6898 | 0.0725 | 0.1171 | 0.1205 | −0.4564 | −0.4814 | 0.0933 | 0.1205 | 0.0029 | 0.0003 |
| Q 8 2 | Q | −0.6905 | 0.0705 | 0.1171 | 0.1205 | −0.4564 | −0.4824 | 0.0908 | 0.1205 | 0.0029 | 0.0003 |
| Q 8 A | Q | −0.6912 | 0.0687 | 0.1171 | 0.1205 | −0.4564 | −0.4833 | 0.0886 | 0.1205 | 0.0029 | 0.0003 |
| Q 7 7 | Q | −0.7170 | 0.1021 | 0.1021 | 0.1205 | −0.4649 | −0.4649 | 0.0047 | 0.1205 | 0.0011 | 0.0001 |
| Q 7 6 | Q | −0.6947 | 0.0884 | 0.0985 | 0.1204 | −0.4670 | −0.4727 | 0.0775 | 0.1204 | 0.0029 | 0.0003 |
| Q 7 5 | Q | −0.6968 | 0.0804 | 0.0985 | 0.1205 | −0.4670 | −0.4771 | 0.0708 | 0.1205 | 0.0029 | 0.0003 |
| Q 7 4 | Q | −0.6983 | 0.0755 | 0.0986 | 0.1205 | −0.4670 | −0.4798 | 0.0661 | 0.1205 | 0.0029 | 0.0003 |
| Q 7 3 | Q | −0.6993 | 0.0725 | 0.0986 | 0.1205 | −0.4670 | −0.4814 | 0.0628 | 0.1205 | 0.0029 | 0.0003 |
| Q 7 2 | Q | −0.7000 | 0.0705 | 0.0986 | 0.1206 | −0.4670 | −0.4824 | 0.0604 | 0.1206 | 0.0029 | 0.0003 |
| Q 7 A | Q | −0.7007 | 0.0687 | 0.0986 | 0.1206 | −0.4670 | −0.4833 | 0.0581 | 0.1206 | 0.0029 | 0.0003 |

TABLE 3-continued

Expected values of all ways to play all hands and optimal playing strategy.

| Hand | Optimal Holds | Discard 1st | Discard 2nd | Discard 3rd | Keep 1st | Keep 2nd | Keep 3rd | Keep All | Best EV | Probability | Return |
|---|---|---|---|---|---|---|---|---|---|---|---|
| Q 6 6 | Q | −0.7170 | 0.0890 | 0.0890 | 0.1206 | −0.4723 | −0.4723 | 0.0047 | 0.1206 | 0.0011 | 0.0001 |
| Q 6 5 | Q | −0.7031 | 0.0805 | 0.0868 | 0.1205 | −0.4736 | −0.4771 | 0.0504 | 0.1205 | 0.0029 | 0.0003 |
| Q 6 4 | Q | −0.7045 | 0.0755 | 0.0868 | 0.1206 | −0.4736 | −0.4797 | 0.0457 | 0.1206 | 0.0029 | 0.0003 |
| Q 6 3 | Q | −0.7056 | 0.0725 | 0.0869 | 0.1206 | −0.4736 | −0.4813 | 0.0424 | 0.1206 | 0.0029 | 0.0003 |
| Q 6 2 | Q | −0.7063 | 0.0705 | 0.0869 | 0.1206 | −0.4735 | −0.4824 | 0.0399 | 0.1206 | 0.0029 | 0.0003 |
| Q 6 A | Q | −0.7070 | 0.0687 | 0.0869 | 0.1206 | −0.4735 | −0.4833 | 0.0377 | 0.1206 | 0.0029 | 0.0003 |
| Q 5 5 | Q | −0.7170 | 0.0808 | 0.0808 | 0.1206 | −0.4769 | −0.4769 | 0.0047 | 0.1206 | 0.0011 | 0.0001 |
| Q 5 4 | Q | −0.7086 | 0.0756 | 0.0795 | 0.1206 | −0.4776 | −0.4797 | 0.0323 | 0.1206 | 0.0029 | 0.0003 |
| Q 5 3 | Q | −0.7096 | 0.0725 | 0.0795 | 0.1206 | −0.4776 | −0.4813 | 0.0290 | 0.1206 | 0.0029 | 0.0003 |
| Q 5 2 | Q | −0.7104 | 0.0705 | 0.0795 | 0.1206 | −0.4776 | −0.4823 | 0.0266 | 0.1206 | 0.0029 | 0.0003 |
| Q 5 A | Q | −0.7111 | 0.0687 | 0.0795 | 0.1206 | −0.4776 | −0.4833 | 0.0244 | 0.1206 | 0.0029 | 0.0003 |
| Q 4 4 | Q | −0.7170 | 0.0757 | 0.0757 | 0.1207 | −0.4796 | −0.4796 | 0.0047 | 0.1207 | 0.0011 | 0.0001 |
| Q 4 3 | Q | −0.7122 | 0.0726 | 0.0750 | 0.1206 | −0.4800 | −0.4813 | 0.0206 | 0.1206 | 0.0029 | 0.0003 |
| Q 4 2 | Q | −0.7130 | 0.0706 | 0.0750 | 0.1207 | −0.4800 | −0.4823 | 0.0181 | 0.1207 | 0.0029 | 0.0003 |
| Q 4 A | Q | −0.7136 | 0.0687 | 0.0750 | 0.1207 | −0.4800 | −0.4833 | 0.0159 | 0.1207 | 0.0029 | 0.0003 |
| Q 3 3 | Q | −0.7170 | 0.0726 | 0.0726 | 0.1207 | −0.4812 | −0.4812 | 0.0047 | 0.1207 | 0.0011 | 0.0001 |
| Q 3 2 | Q | −0.7145 | 0.0706 | 0.0722 | 0.1207 | −0.4815 | −0.4823 | 0.0131 | 0.1207 | 0.0029 | 0.0003 |
| Q 3 A | Q | −0.7152 | 0.0687 | 0.0722 | 0.1207 | −0.4815 | −0.4833 | 0.0108 | 0.1207 | 0.0029 | 0.0003 |
| Q 2 2 | Q | −0.7170 | 0.0706 | 0.0706 | 0.1207 | −0.4823 | −0.4823 | 0.0047 | 0.1207 | 0.0011 | 0.0001 |
| Q 2 A | Q | −0.7159 | 0.0687 | 0.0702 | 0.1207 | −0.4825 | −0.4833 | 0.0086 | 0.1207 | 0.0029 | 0.0003 |
| Q A A | Q | −0.7170 | 0.0686 | 0.0686 | 0.1207 | −0.4833 | −0.4833 | 0.0047 | 0.1207 | 0.0011 | 0.0001 |
| J J J | J | −0.7330 | −0.7330 | −0.7330 | 0.0237 | 0.0237 | 0.0237 | −0.1827 | 0.0237 | 0.0002 | 0.0000 |
| J J 10 | J 10 | −0.0288 | −0.0288 | −0.7310 | −0.0458 | −0.0458 | −0.1944 | −0.4781 | −0.0288 | 0.0011 | 0.0000 |
| J J 9 | J | −0.0851 | −0.0851 | −0.7239 | −0.0451 | −0.0451 | −0.4489 | −1.0000 | −0.0451 | 0.0011 | 0.0000 |
| J J 8 | J | −0.1069 | −0.1069 | −0.7239 | −0.0451 | −0.0451 | −0.4659 | −1.0000 | −0.0451 | 0.0011 | 0.0000 |
| J J 7 | J | −0.1210 | −0.1210 | −0.7239 | −0.0451 | −0.0451 | −0.4766 | −1.0000 | −0.0451 | 0.0011 | 0.0000 |
| J J 6 | J | −0.1300 | −0.1300 | −0.7239 | −0.0450 | −0.0450 | −0.4833 | −1.0000 | −0.0450 | 0.0011 | 0.0000 |
| J J 5 | J | −0.1357 | −0.1357 | −0.7239 | −0.0450 | −0.0450 | −0.4874 | −1.0000 | −0.0450 | 0.0011 | 0.0000 |
| J J 4 | J | −0.1392 | −0.1392 | −0.7239 | −0.0450 | −0.0450 | −0.4899 | −1.0000 | −0.0450 | 0.0011 | 0.0000 |
| J J 3 | J | −0.1414 | −0.1414 | −0.7239 | −0.0450 | −0.0450 | −0.4914 | −1.0000 | −0.0450 | 0.0011 | 0.0000 |
| J J 2 | J | −0.1428 | −0.1428 | −0.7239 | −0.0450 | −0.0450 | −0.4924 | −1.0000 | −0.0450 | 0.0011 | 0.0000 |
| J J A | J | −0.1442 | −0.1442 | −0.7239 | −0.0450 | −0.0450 | −0.4933 | −1.0000 | −0.0450 | 0.0011 | 0.0000 |
| J 10 10 | J 10 | −0.7310 | −0.0351 | −0.0351 | −0.1031 | −0.1813 | −0.1813 | −0.3346 | −0.0351 | 0.0011 | 0.0000 |
| J 10 9 | J 10 | −0.2704 | −0.1208 | −0.0526 | −0.1022 | −0.2192 | −0.4505 | −0.0854 | −0.0526 | 0.0029 | −0.0002 |
| J 10 8 | J 10 | −0.3018 | −0.1522 | −0.0526 | −0.1021 | −0.2192 | −0.04665 | −0.1019 | −0.0526 | 0.0029 | −0.0002 |
| J 10 7 | J 10 | −0.3219 | −0.1723 | −0.0526 | −0.1021 | −0.2191 | −0.4767 | −0.1145 | −0.0526 | 0.0029 | −0.0002 |
| J 10 6 | J 10 | −0.3347 | −0.1850 | −0.0525 | −0.1020 | −0.2191 | −0.4830 | −0.1239 | −0.0525 | 0.0029 | −0.0002 |
| J 10 5 | J 10 | −0.3426 | −0.1930 | −0.0525 | −0.1020 | −0.2190 | −0.4869 | −0.1307 | −0.0525 | 0.0029 | −0.0002 |
| J 10 4 | J 10 | −0.3475 | −0.1979 | −0.0525 | −0.1020 | −0.2190 | −0.4892 | −0.1354 | −0.0525 | 0.0029 | −0.0002 |
| J 10 3 | J 10 | −0.3506 | −0.2010 | −0.0525 | −0.1019 | −0.2190 | −0.4906 | −0.1387 | −0.0525 | 0.0029 | −0.0002 |
| J 10 2 | J 10 | −0.3526 | −0.2030 | −0.0525 | −0.1019 | −0.2190 | −0.4916 | −0.1411 | −0.0525 | 0.0029 | −0.0002 |
| J 10 A | J 10 | −0.3544 | −0.2048 | −0.0525 | −0.1019 | −0.2190 | −0.4924 | −0.1433 | −0.0525 | 0.0029 | −0.0002 |
| J 9 9 | J | −0.7168 | −0.1184 | −0.1184 | −0.1011 | −0.4335 | −0.4335 | −0.3346 | −0.1011 | 0.0011 | −0.0001 |
| J 9 8 | J | −0.6641 | −0.1521 | −0.1277 | −0.1012 | −0.4392 | −0.4536 | −0.1648 | −0.1012 | 0.0029 | −0.0003 |
| J 9 7 | J | −0.6681 | −0.1723 | −0.1276 | −0.1012 | −0.4392 | −0.4652 | −0.1775 | −0.1012 | 0.0029 | −0.0003 |
| J 9 6 | J | −0.6711 | −0.1850 | −0.1276 | −0.1011 | −0.4392 | −0.4723 | −0.1869 | −0.1011 | 0.0029 | −0.0003 |
| J 9 5 | J | −0.6732 | −0.1930 | −0.1276 | −0.1011 | −0.4391 | −0.4767 | −0.1936 | −0.1011 | 0.0029 | −0.0003 |
| J 9 4 | J | −0.6747 | −0.1979 | −0.1276 | −0.1010 | −0.4391 | −0.4793 | −0.1983 | −0.1010 | 0.0029 | −0.0003 |
| J 9 3 | J | −0.6757 | −0.2009 | −0.1275 | −0.1010 | −0.4391 | −0.4809 | −0.2016 | −0.1010 | 0.0029 | −0.0003 |
| J 9 2 | J | −0.6764 | −0.2029 | −0.1275 | −0.1010 | −0.4391 | −0.4819 | −0.2040 | −0.1010 | 0.0029 | −0.0003 |
| J 9 A | J | −0.6771 | −0.2047 | −0.1275 | −0.1010 | −0.4391 | −0.4829 | −0.2063 | −0.1010 | 0.0029 | −0.0003 |
| J 8 8 | J | −0.7168 | −0.1506 | −0.1506 | −0.1010 | −0.4524 | −0.4524 | −0.3346 | −0.1010 | 0.0011 | −0.0001 |
| J 8 7 | J | −0.6820 | −0.1722 | −0.1564 | −0.1011 | −0.4560 | −0.4651 | −0.2219 | −0.1011 | 0.0029 | −0.0003 |
| J 8 6 | J | −0.6849 | −0.1850 | −0.1564 | −0.1011 | −0.4560 | −0.4723 | −0.2313 | −0.1011 | 0.0029 | −0.0003 |
| J 8 5 | J | −0.6871 | −0.1929 | −0.1563 | −0.1010 | −0.4560 | −0.4767 | −0.2380 | −0.1010 | 0.0029 | −0.0003 |
| J 8 4 | J | −0.6885 | −0.1979 | −0.1563 | −0.1010 | −0.4559 | −0.4793 | −0.2427 | −0.1010 | 0.0029 | −0.0003 |
| J 8 3 | J | −0.6895 | −0.2009 | −0.1563 | −0.1010 | −0.4559 | −0.4809 | −0.2460 | −0.1010 | 0.0029 | −0.0003 |
| J 8 2 | J | −0.6903 | −0.2029 | −0.1563 | −0.1010 | −0.4559 | −0.4819 | −0.2484 | −0.1010 | 0.0029 | −0.0003 |
| J 8 A | J | −0.6910 | −0.2047 | −0.1563 | −0.1009 | −0.4559 | −0.4829 | −0.2507 | −0.1009 | 0.0029 | −0.0003 |
| J 7 7 | J | −0.7168 | −0.1713 | −0.1713 | −0.1009 | −0.4644 | −0.4644 | −0.3346 | −0.1009 | 0.0011 | −0.0001 |
| J 7 6 | J | −0.6944 | −0.1850 | −0.1749 | −0.1010 | −0.4666 | −0.4723 | −0.2618 | −0.1010 | 0.0029 | −0.0003 |
| J 7 5 | J | −0.6965 | −0.1929 | −0.1748 | −0.1010 | −0.4665 | −0.4766 | −0.2685 | −0.1010 | 0.0029 | −0.0003 |
| J 7 4 | J | −0.6980 | −0.1978 | −0.1748 | −0.1009 | −0.4665 | −0.4793 | −0.2732 | −0.1009 | 0.0029 | −0.0003 |
| J 7 3 | J | −0.6990 | −0.2009 | −0.1748 | −0.1009 | −0.4665 | −0.4809 | −0.2765 | −0.1009 | 0.0029 | −0.0003 |
| J 7 2 | J | −0.6997 | −0.2029 | −0.1748 | −0.1009 | −0.4665 | −0.4819 | −0.2789 | −0.1009 | 0.0029 | −0.0003 |
| J 7 A | J | −0.7004 | −0.2047 | −0.1748 | −0.1009 | −0.4665 | −0.4828 | −0.2812 | −0.1009 | 0.0029 | −0.0003 |
| J 6 6 | J | −0.7168 | −0.1844 | −0.1844 | −0.1009 | −0.4719 | −0.4719 | −0.3346 | −0.1009 | 0.0011 | −0.0001 |
| J 6 5 | J | −0.7028 | −0.1929 | −0.1865 | −0.1009 | −0.4731 | −0.4766 | −0.2889 | −0.1009 | 0.0029 | −0.0003 |
| J 6 4 | J | −0.7043 | −0.1978 | −0.1865 | −0.1009 | −0.4731 | −0.4793 | −0.2936 | −0.1009 | 0.0029 | −0.0003 |
| J 6 3 | J | −0.7053 | −0.2008 | −0.1865 | −0.1009 | −0.4731 | −0.4809 | −0.2969 | −0.1009 | 0.0029 | −0.0003 |
| J 6 2 | J | −0.7060 | −0.2028 | −0.1865 | −0.1009 | −0.4731 | −0.4819 | −0.2993 | −0.1009 | 0.0029 | −0.0003 |
| J 6 A | J | −0.7067 | −0.2047 | −0.1865 | −0.1009 | −0.4731 | −0.4828 | −0.3016 | −0.1009 | 0.0029 | −0.0003 |
| J 5 5 | J | −0.7168 | −0.1926 | −0.1926 | −0.1008 | −0.4764 | −0.4764 | −0.3346 | −0.1008 | 0.0011 | −0.0001 |
| J 5 4 | J | −0.7084 | −0.1978 | −0.1938 | −0.1009 | −0.4771 | −0.4793 | −0.3070 | −0.1009 | 0.0029 | −0.0003 |

TABLE 3-continued

Expected values of all ways to play all hands and optimal playing strategy.

| Hand | Optimal Holds | Discard 1st | Discard 2nd | Discard 3rd | Keep 1st | Keep 2nd | Keep 3rd | Keep All | Best EV | Probability | Return |
|---|---|---|---|---|---|---|---|---|---|---|---|
| J 5 3 | J | −0.7094 | −0.2008 | −0.1938 | −0.1008 | −0.4771 | −0.4809 | −0.3102 | −0.1008 | 0.0029 | −0.0003 |
| J 5 2 | J | −0.7101 | −0.2028 | −0.1938 | −0.1008 | −0.4771 | −0.4819 | −0.3127 | −0.1008 | 0.0029 | −0.0003 |
| J 5 A | J | −0.7108 | −0.2046 | −0.1938 | −0.1008 | −0.4771 | −0.4828 | −0.3149 | −0.1008 | 0.0029 | −0.0003 |
| J 4 4 | J | −0.7168 | −0.1976 | −0.1976 | −0.1008 | −0.4791 | −0.4791 | −0.3346 | −0.1008 | 0.0011 | −0.0001 |
| J 4 3 | J | −0.7120 | −0.2008 | −0.1984 | −0.1008 | −0.4796 | −0.4809 | −0.3187 | −0.1008 | 0.0029 | −0.0003 |
| J 4 2 | J | −0.7127 | −0.2028 | −0.1984 | −0.1008 | −0.4795 | −0.4819 | −0.3212 | −0.1008 | 0.0029 | −0.0003 |
| J 4 A | J | −0.7134 | −0.2046 | −0.1984 | −0.1008 | −0.4795 | −0.4828 | −0.3234 | −0.1008 | 0.0029 | −0.0003 |
| J 3 3 | J | −0.7168 | −0.2007 | −0.2007 | −0.1008 | −0.4808 | −0.4808 | −0.3346 | −0.1008 | 0.0011 | −0.0001 |
| J 3 2 | J | −0.7142 | −0.2028 | −0.2012 | −0.1008 | −0.4810 | −0.4819 | −0.3262 | −0.1008 | 0.0029 | −0.0003 |
| J 3 A | J | −0.7149 | −0.2046 | −0.2012 | −0.1008 | −0.4810 | −0.4828 | −0.3284 | −0.1008 | 0.0029 | −0.0003 |
| J 2 2 | J | −0.7168 | −0.2028 | −0.2028 | −0.1007 | −0.4819 | −0.4819 | −0.3346 | −0.1007 | 0.0011 | −0.0001 |
| J 2 A | J | −0.7156 | −0.2046 | −0.2031 | −0.1008 | −0.4820 | −0.4828 | −0.3307 | −0.1008 | 0.0029 | −0.0003 |
| J A A | J | −0.7168 | −0.2048 | −0.2048 | −0.1007 | −0.4829 | −0.4829 | −0.3346 | −0.1007 | 0.0011 | −0.0001 |
| 10 10 10 | 10 | −0.7328 | −0.7328 | −0.7328 | −0.1571 | −0.1571 | −0.1571 | −0.4644 | −0.1571 | 0.0002 | 0.0000 |
| 10 10 9 | 10 | −0.2819 | −0.2819 | −0.7237 | −0.2001 | −0.2001 | −0.4485 | −1.0000 | −0.2001 | 0.0011 | −0.0002 |
| 10 10 8 | 10 | −0.3037 | −0.3037 | −0.7237 | −0.2001 | −0.2001 | −0.4655 | −1.0000 | −0.2001 | 0.0011 | −0.0002 |
| 10 10 7 | 10 | −0.3178 | −0.3178 | −0.7237 | −0.2001 | −0.2001 | −0.4763 | −1.0000 | −0.2001 | 0.0011 | −0.0002 |
| 10 10 6 | 10 | −0.3268 | −0.3268 | −0.7237 | −0.2000 | −0.2000 | −0.4829 | −1.0000 | −0.2000 | 0.0011 | −0.0002 |
| 10 10 5 | 10 | −0.3325 | −0.3325 | −0.7237 | −0.2000 | −0.2000 | −0.4871 | −1.0000 | −0.2000 | 0.0011 | −0.0002 |
| 10 10 4 | 10 | −0.3360 | −0.3360 | −0.7237 | −0.2000 | −0.2000 | −0.4896 | −1.0000 | −0.2000 | 0.0011 | −0.0002 |
| 10 10 3 | 10 | −0.3382 | −0.3382 | −0.7237 | −0.2000 | −0.2000 | −0.4911 | −1.0000 | −0.2000 | 0.0011 | −0.0002 |
| 10 10 2 | 10 | −0.3397 | −0.3397 | −0.7237 | −0.2000 | −0.2000 | −0.4920 | −1.0000 | −0.2000 | 0.0011 | −0.0002 |
| 10 10 A | 10 | −0.3410 | −0.3410 | −0.7237 | −0.2000 | −0.2000 | −0.4929 | −1.0000 | −0.2000 | 0.0011 | −0.0002 |
| 10 9 9 | 10 | −0.7165 | −0.2932 | −0.2932 | −0.2347 | −0.4331 | −0.4331 | −0.5672 | −0.2347 | 0.0011 | −0.0003 |
| 10 9 8 | 10 | −0.6639 | −0.3269 | −0.3025 | −0.2348 | −0.4389 | −0.4532 | −0.3974 | −0.2348 | 0.0029 | −0.0007 |
| 10 9 7 | 10 | −0.6679 | −0.3471 | −0.3025 | −0.2347 | −0.4388 | −0.4648 | −0.4101 | −0.2347 | 0.0029 | −0.0007 |
| 10 9 6 | 10 | −0.6709 | −0.3598 | −0.3024 | −0.2347 | −0.4388 | −0.4720 | −0.4195 | −0.2347 | 0.0029 | −0.0007 |
| 10 9 5 | 10 | −0.6730 | −0.3678 | −0.3024 | −0.2347 | −0.4388 | −0.4763 | −0.4262 | −0.2347 | 0.0029 | −0.0007 |
| 10 9 4 | 10 | −0.6745 | −0.3727 | −0.3024 | −0.2346 | −0.4388 | −0.4790 | −0.4309 | −0.2346 | 0.0029 | −0.0007 |
| 10 9 3 | 10 | −0.6755 | −0.3758 | −0.3024 | −0.2346 | −0.4388 | −0.4806 | −0.4342 | −0.2346 | 0.0029 | −0.0007 |
| 10 9 2 | 10 | −0.6762 | −0.3778 | −0.3024 | −0.2346 | −0.4388 | −0.4816 | −0.4366 | −0.2346 | 0.0029 | −0.0007 |
| 10 9 A | 10 | −0.6769 | −0.3796 | −0.3024 | −0.2346 | −0.4388 | −0.4825 | −0.4388 | −0.2346 | 0.0029 | −0.0007 |
| 10 8 8 | 10 | −0.7165 | −0.3254 | −0.3254 | −0.2346 | −0.4521 | −0.4521 | −0.5672 | −0.2346 | 0.0011 | −0.0003 |
| 10 8 7 | 10 | −0.6818 | −0.3471 | −0.3312 | −0.2347 | −0.4557 | −0.4648 | −0.4545 | −0.2347 | 0.0029 | −0.0007 |
| 10 8 6 | 10 | −0.6847 | −0.3598 | −0.3312 | −0.2346 | −0.4556 | −0.4719 | −0.4639 | −0.2346 | 0.0029 | −0.0007 |
| 10 8 5 | 10 | −0.6868 | −0.3678 | −0.3312 | −0.2346 | −0.4556 | −0.4763 | −0.4706 | −0.2346 | 0.0029 | −0.0007 |
| 10 8 4 | 10 | −0.6883 | −0.3727 | −0.3312 | −0.2346 | −0.4556 | −0.4790 | −0.4753 | −0.2346 | 0.0029 | −0.0007 |
| 10 8 3 | 10 | −0.6893 | −0.3757 | −0.3311 | −0.2346 | −0.4556 | −0.4806 | −0.4786 | −0.2346 | 0.0029 | −0.0007 |
| 10 8 2 | 10 | −0.6901 | −0.3777 | −0.3311 | −0.2345 | −0.4556 | −0.4816 | −0.4810 | −0.2345 | 0.0029 | −0.0007 |
| 10 8 A | 10 | −0.6907 | −0.3795 | −0.3311 | −0.2345 | −0.4556 | −0.4825 | −0.4833 | −0.2345 | 0.0029 | −0.0007 |
| 10 7 7 | 10 | −0.7165 | −0.3461 | −0.3461 | −0.2345 | −0.4641 | −0.4641 | −0.5672 | −0.2345 | 0.0011 | −0.0003 |
| 10 7 6 | 10 | −0.6942 | −0.3598 | −0.3497 | −0.2346 | −0.4662 | −0.4719 | −0.4944 | −0.2346 | 0.0029 | −0.0007 |
| 10 7 5 | 10 | −0.6963 | −0.3677 | −0.3497 | −0.2346 | −0.4662 | −0.4763 | −0.5011 | −0.2346 | 0.0029 | −0.0007 |
| 10 7 4 | 10 | −0.6978 | −0.3727 | −0.3496 | −0.2345 | −0.4662 | −0.4790 | −0.5058 | −0.2345 | 0.0029 | −0.0007 |
| 10 7 3 | 10 | −0.6988 | −0.3757 | −0.3496 | −0.2345 | −0.4662 | −0.4805 | −0.5091 | −0.2345 | 0.0029 | −0.0007 |
| 10 7 2 | 10 | −0.6995 | −0.3777 | −0.3496 | −0.2345 | −0.4662 | −0.4816 | −0.5115 | −0.2345 | 0.0029 | −0.0007 |
| 10 7 A | 10 | −0.7002 | −0.3795 | −0.3496 | −0.2345 | −0.4662 | −0.4825 | −0.5137 | −0.2345 | 0.0029 | −0.0007 |
| 10 6 6 | 10 | −0.7165 | −0.3592 | −0.3592 | −0.2345 | −0.4715 | −0.4715 | −0.5672 | −0.2345 | 0.0011 | −0.0003 |
| 10 6 5 | 10 | −0.7026 | −0.3677 | −0.3614 | −0.2345 | −0.4728 | −0.4763 | −0.5215 | −0.2345 | 0.029 | −0.0007 |
| 10 6 4 | 10 | −0.7041 | −0.3726 | −0.3614 | −0.2345 | −0.4728 | −0.4789 | −0.5262 | −0.2345 | 0.0029 | −0.0007 |
| 10 6 3 | 10 | −0.7051 | −0.3757 | −0.3613 | −0.2345 | −0.4728 | −0.4805 | −0.5295 | −0.2345 | 0.0029 | −0.0007 |
| 10 6 2 | 10 | −0.7058 | −0.3777 | −0.3613 | −0.2344 | −0.4727 | −0.4816 | −0.5319 | −0.2344 | 0.0029 | −0.0007 |
| 10 6 A | 10 | −0.7065 | −0.3795 | −0.3613 | −0.2344 | −0.4727 | −0.4825 | −0.5342 | −0.2344 | 0.0029 | −0.0007 |
| 10 5 5 | 10 | −0.7165 | −0.3674 | −0.3674 | −0.2344 | −0.4761 | −0.4761 | −0.5672 | −0.2344 | 0.0011 | −0.0003 |
| 10 5 4 | 10 | −0.7081 | −0.3726 | −0.3687 | −0.2344 | −0.4768 | −0.4789 | −0.5396 | −0.2344 | 0.0029 | −0.0007 |
| 10 5 3 | 10 | −0.7092 | −0.3757 | −0.3687 | −0.2344 | −0.4768 | −0.4805 | −0.5428 | −0.2344 | 0.0029 | −0.0007 |
| 10 5 2 | 10 | −0.7099 | −0.3777 | −0.3687 | −0.2344 | −0.4768 | −0.4815 | −0.5453 | −0.2344 | 0.0029 | −0.0007 |
| 10 5 A | 10 | −0.7106 | −0.3795 | −0.3687 | −0.2344 | −0.4768 | −0.4825 | −0.5475 | −0.2344 | 0.0029 | −0.0007 |
| 10 4 4 | 10 | −0.7165 | −0.3725 | −0.3725 | −0.2344 | −0.4788 | −0.4788 | −0.5672 | −0.2344 | 0.0011 | −0.0003 |
| 10 4 3 | 10 | −0.7117 | −0.3756 | −0.3732 | −0.2344 | −0.4792 | −0.4805 | −0.5513 | −0.2344 | 0.0029 | −0.0007 |
| 10 4 2 | 10 | −0.7125 | −0.3776 | −0.3732 | −0.2344 | −0.4792 | −0.4815 | −0.5538 | −0.2344 | 0.0029 | −0.0007 |
| 10 4 A | 10 | −0.7132 | −0.3795 | −0.3732 | −0.2344 | −0.4792 | −0.4825 | −0.5560 | −0.02344 | 0.0029 | −0.0007 |
| 10 3 3 | 10 | −0.7165 | −0.3756 | −0.3756 | −0.2344 | −0.4804 | −0.4804 | −0.5672 | −0.2344 | 0.0011 | −0.0003 |
| 10 3 2 | 10 | −0.7140 | −0.3776 | −0.3760 | −0.2344 | −0.4807 | −0.4815 | −0.5588 | −0.2344 | 0.0029 | −0.0007 |
| 10 3 A | 10 | −0.7147 | −0.3795 | −0.3760 | −0.2344 | −0.4807 | −0.4825 | −0.5610 | −0.2344 | 0.0029 | −0.0007 |
| 10 2 2 | 10 | −0.7165 | −0.3776 | −0.3776 | −0.2343 | −0.4815 | −0.4815 | −0.5672 | −0.2343 | 0.0011 | −0.0003 |
| 10 2 A | 10 | −0.7154 | −0.3795 | −0.3780 | −0.2343 | −0.4817 | −0.4825 | −0.5632 | −0.2343 | 0.0029 | −0.0007 |
| 10 A A | 10 | −0.7165 | −0.3796 | −0.3796 | −0.2343 | −0.4825 | −0.4825 | −0.5672 | −0.2343 | 0.0011 | −0.0003 |
| 9 9 9 | 9 | −0.7106 | −0.7106 | −0.7106 | −0.4164 | −0.4164 | −0.4164 | −1.0000 | −0.4164 | 0.0002 | −0.0001 |
| 9 9 8 | 9 | −0.6551 | −0.6551 | −0.7107 | −0.4235 | −0.4235 | −0.4406 | −1.0000 | −0.4235 | 0.0011 | −0.0005 |
| 9 9 7 | 9 | −0.6582 | −0.6582 | −0.7107 | −0.4235 | −0.4235 | −0.4538 | −1.0000 | −0.4235 | 0.0011 | −0.0005 |
| 9 9 6 | 9 | −0.6604 | −0.6604 | −0.7107 | −0.4235 | −0.4235 | −0.4619 | −1.0000 | −0.4235 | 0.0011 | −0.0005 |
| 9 9 5 | 9 | −0.6621 | −0.6621 | −0.7107 | −0.4235 | −0.4235 | −0.4669 | −1.0000 | −0.4235 | 0.0011 | −0.0005 |

TABLE 3-continued

Expected values of all ways to play all hands and optimal playing strategy.

| Hand | Optimal Holds | Discard 1st | Discard 2nd | Discard 3rd | Keep 1st | Keep 2nd | Keep 3rd | Keep All | Best EV | Probability | Return |
|---|---|---|---|---|---|---|---|---|---|---|---|
| 9 9 4 | 9 | −0.6632 | −0.6632 | −0.7107 | −0.4234 | −0.4234 | −0.4699 | −1.0000 | −0.4235 | 0.0011 | −0.0005 |
| 9 9 3 | 9 | −0.6640 | −0.6640 | −0.7107 | −0.4234 | −0.4234 | −0.4717 | −1.0000 | −0.4234 | 0.0011 | −0.0005 |
| 9 9 2 | 9 | −0.6646 | −0.6646 | −0.7107 | −0.4234 | −0.4234 | −0.4729 | −1.0000 | −0.4234 | 0.0011 | −0.0005 |
| 9 9 A | 9 | −0.6651 | −0.6651 | −0.7107 | −0.4234 | −0.4234 | −0.4740 | −1.0000 | −0.4234 | 0.0011 | −0.0005 |
| 9 8 8 | 9 | −0.7107 | −0.6551 | −0.6551 | −0.4293 | −0.4402 | −0.4402 | −1.0000 | −0.4293 | 0.0011 | −0.0005 |
| 9 8 7 | 9 | −0.6711 | −0.6591 | −0.6556 | −0.4294 | −0.4442 | −0.4544 | −1.0000 | −0.4294 | 0.0029 | −0.0012 |
| 9 8 6 | 9 | −0.6745 | −0.6625 | −0.6556 | −0.4293 | −0.4442 | −0.4624 | −1.0000 | −0.4293 | 0.0029 | −0.0012 |
| 9 8 5 | 9 | −0.6769 | −0.6649 | −0.6556 | −0.4293 | −0.4441 | −0.4672 | −1.0000 | −0.4293 | 0.0029 | −0.0012 |
| 9 8 4 | 9 | −0.6786 | −0.6665 | −0.6556 | −0.4293 | −0.4441 | −0.4702 | −1.0000 | −0.4293 | 0.0029 | −0.0012 |
| 9 8 3 | 9 | −0.6797 | −0.6677 | −0.6556 | −0.4293 | −0.4441 | −0.4719 | −1.0000 | −0.4293 | 0.0029 | −0.0012 |
| 9 8 2 | 9 | −0.6806 | −0.6685 | −0.6556 | −0.4293 | −0.4441 | −0.4730 | −1.0000 | −0.4293 | 0.0029 | −0.0012 |
| 9 8 A | 9 | −0.6813 | −0.6693 | −0.6556 | −0.4293 | −0.4441 | −0.4740 | −1.0000 | −0.4293 | 0.0029 | −0.0012 |
| 9 7 7 | 9 | −0.7107 | −0.6595 | −0.6595 | −0.4293 | −0.4536 | −0.4536 | −1.0000 | −0.4293 | 0.0011 | −0.0005 |
| 9 7 6 | 9 | −0.6853 | −0.6625 | −0.6599 | −0.4293 | −0.4560 | −0.4624 | −1.0000 | −0.4293 | 0.0029 | −0.0012 |
| 9 7 5 | 9 | −0.6877 | −0.6649 | −0.6599 | −0.4293 | −0.4560 | −0.4672 | −1.0000 | −0.4293 | 0.0029 | −0.0012 |
| 9 7 4 | 9 | −0.6894 | −0.6665 | −0.6599 | −0.4293 | −0.4560 | −0.4701 | −1.0000 | −0.4293 | 0.0029 | −0.0012 |
| 9 7 3 | 9 | −0.6905 | −0.6677 | −0.6599 | −0.4293 | −0.4559 | −0.4719 | −1.0000 | −0.4293 | 0.0029 | −0.0012 |
| 9 7 2 | 9 | −0.6913 | −0.6685 | −0.6599 | −0.4293 | −0.4559 | −0.4730 | −1.0000 | −0.4293 | 0.0029 | −0.0012 |
| 9 7 A | 9 | −0.6921 | −0.6693 | −0.6599 | −0.4293 | −0.4559 | −0.4740 | −1.0000 | −0.4293 | 0.0029 | −0.0012 |
| 9 6 6 | 9 | −0.7107 | −0.6627 | −0.6627 | −0.4293 | −0.4619 | −0.4619 | −1.0000 | −0.4293 | 0.0011 | −0.0012 |
| 9 6 5 | 9 | −0.6948 | −0.6649 | −0.6630 | −0.4293 | −0.4633 | −0.4672 | −1.0000 | −0.4293 | 0.0029 | −0.0012 |
| 9 6 4 | 9 | −0.6965 | −0.6665 | −0.6630 | −0.4293 | −0.4633 | −0.4701 | −1.0000 | −0.4293 | 0.0029 | −0.0012 |
| 9 6 3 | 9 | −0.6977 | −0.6677 | −0.6630 | −0.4293 | −0.4633 | −0.4719 | −1.0000 | −0.4293 | 0.0029 | −0.0012 |
| 9 6 2 | 9 | −0.6985 | −0.6685 | −0.6630 | −0.4292 | −0.4633 | −0.4730 | −1.0000 | −0.4292 | 0.0029 | −0.0012 |
| 9 6 A | 9 | −0.6993 | −0.6693 | −0.6630 | −0.4292 | −0.4633 | −0.4740 | −1.0000 | −0.4292 | 0.0029 | −0.0012 |
| 9 5 5 | 9 | −0.7107 | −0.6651 | −0.6651 | −0.4292 | −0.4669 | −0.4669 | −1.0000 | −0.4292 | 0.0011 | −0.0005 |
| 9 5 4 | 9 | −0.7012 | −0.6665 | −0.6653 | −0.4292 | −0.4677 | −0.4701 | −1.0000 | −0.4292 | 0.0029 | −0.0012 |
| 9 5 3 | 9 | −0.7023 | −0.6677 | −0.6653 | −0.4292 | −0.4677 | −0.4719 | −1.0000 | −0.4292 | 0.0029 | −0.0012 |
| 9 5 2 | 9 | −0.7032 | −0.6685 | −0.6653 | −0.4292 | −0.4677 | −0.4730 | −1.0000 | −0.4292 | 0.0029 | −0.0012 |
| 9 5 A | 9 | −0.7039 | −0.6693 | −0.6653 | −0.4292 | −0.4677 | −0.4740 | −1.0000 | −0.4292 | 0.0029 | −0.0012 |
| 9 4 4 | 9 | −0.7107 | −0.6667 | −0.6667 | −0.4292 | −0.4700 | −0.4700 | −1.0000 | −0.4292 | 0.0011 | −0.0005 |
| 9 4 3 | 9 | −0.7052 | −0.6677 | −0.6668 | −0.4292 | −0.4704 | −0.4719 | −1.0000 | −0.4292 | 0.0029 | −0.0012 |
| 9 4 2 | 9 | −0.7061 | −0.6685 | −0.6668 | −0.4292 | −0.4704 | −0.4730 | −1.0000 | −0.4292 | 0.0029 | −0.0012 |
| 9 4 A | 9 | −0.7069 | −0.6693 | −0.6668 | −0.4292 | −0.4704 | −0.4740 | −1.0000 | −0.4292 | 0.0029 | −0.0012 |
| 9 3 3 | 9 | −0.7107 | −0.6678 | −0.6678 | −0.4292 | −0.4718 | −0.4718 | −1.0000 | −0.4292 | 0.0011 | −0.0005 |
| 9 3 2 | 9 | −0.7078 | −0.6685 | −0.6679 | −0.4292 | −0.4720 | −0.4730 | −1.0000 | −0.4292 | 0.0029 | −0.0012 |
| 9 3 A | 9 | −0.7086 | −0.6693 | −0.6679 | −0.4292 | −0.4720 | −0.4740 | −1.0000 | −0.4292 | 0.0029 | −0.0012 |
| 9 2 2 | 9 | −0.7107 | −0.6686 | −0.6686 | −0.4292 | −0.4729 | −0.4729 | −1.0000 | −0.4292 | 0.0011 | −0.0005 |
| 9 2 A | 9 | −0.7094 | −0.6693 | −0.6687 | −0.4292 | −0.4731 | −0.4740 | −1.0000 | −0.4292 | 0.0029 | −0.0012 |
| 9 A A | 9 | −0.7107 | −0.6694 | −0.6694 | −0.4292 | −0.4740 | −0.4740 | −1.0000 | −0.4292 | 0.0011 | −0.0005 |
| 8 8 8 | 8 | −0.7106 | −0.7106 | −0.7106 | −0.4385 | −0.4385 | −0.4385 | −1.0000 | −0.4385 | 0.0002 | −0.0001 |
| 8 8 7 | 8 | −0.6741 | −0.6741 | −0.7107 | −0.4430 | −0.4430 | −0.4538 | −1.0000 | −0.4430 | 0.0011 | −0.0005 |
| 8 8 6 | 8 | −0.6763 | −0.6763 | −0.7107 | −0.4430 | −0.4430 | −0.4619 | −1.0000 | −0.4430 | 0.0011 | −0.0005 |
| 8 8 5 | 8 | −0.6780 | −0.6780 | −0.7107 | −0.4429 | −0.4429 | −0.4669 | −1.0000 | −0.4429 | 0.0011 | −0.0005 |
| 8 8 4 | 8 | −0.6791 | −0.6791 | −0.7107 | −0.4429 | −0.4429 | −0.4699 | −1.0000 | −0.4429 | 0.0011 | −0.0005 |
| 8 8 3 | 8 | −0.6799 | −0.6799 | −0.7107 | −0.4429 | −0.4429 | −0.4717 | −1.0000 | −0.4429 | 0.0011 | −0.0005 |
| 8 8 2 | 8 | −0.6805 | −0.6805 | −0.7107 | −0.4429 | −0.4429 | −0.4729 | −1.0000 | −0.4429 | 0.0011 | −0.0005 |
| 8 8 A | 8 | −0.6810 | −0.6810 | −0.7107 | −0.4429 | −0.4429 | −0.4739 | −1.0000 | −0.4429 | 0.0011 | −0.0005 |
| 8 7 7 | 8 | −0.7107 | −0.6741 | −0.6741 | −0.4466 | −0.4535 | −0.4535 | −1.0000 | −0.4466 | 0.0011 | −0.0005 |
| 8 7 6 | 8 | −0.6853 | −0.6770 | −0.6745 | −0.4466 | −0.4560 | −0.4623 | −1.0000 | −0.4466 | 0.0029 | −0.0013 |
| 8 7 5 | 8 | −0.6877 | −0.6794 | −0.6745 | −0.4466 | −0.4560 | −0.4672 | −1.0000 | −0.4466 | 0.0029 | −0.0013 |
| 8 7 4 | 8 | −0.6894 | −0.6811 | −0.6745 | −0.4466 | −0.4560 | −0.4701 | −1.0000 | −0.4466 | 0.0029 | −0.0013 |
| 8 7 3 | 8 | −0.6905 | −0.6822 | −0.6745 | −0.4466 | −0.4559 | −0.4719 | −1.0000 | −0.4466 | 0.0029 | −0.0013 |
| 8 7 2 | 8 | −0.6913 | −0.6831 | −0.6745 | −0.4465 | −0.4559 | −0.4730 | −1.0000 | −0.4466 | 0.0029 | −0.0013 |
| 8 7 A | 8 | −0.6921 | −0.6839 | −0.6745 | −0.4465 | −0.4559 | −0.4740 | −1.0000 | −0.4465 | 0.0029 | −0.0013 |
| 8 6 6 | 8 | −0.7107 | −0.6773 | −0.6773 | −0.4465 | −0.4618 | −0.4618 | −1.0000 | −0.4465 | 0.0011 | −0.0005 |
| 8 6 5 | 8 | −0.6948 | −0.6794 | −0.6776 | −0.4466 | −0.4633 | −0.4672 | −1.0000 | −0.4466 | 0.0029 | −0.0013 |
| 8 6 4 | 8 | −0.6965 | −0.6811 | −0.6776 | −0.4465 | −0.4632 | −0.4701 | −1.0000 | −0.4465 | 0.0029 | −0.0013 |
| 8 6 3 | 8 | −0.6977 | −0.6822 | −0.6776 | −0.4465 | −0.4632 | −0.4719 | −1.0000 | −0.4465 | 0.0029 | −0.0013 |
| 8 6 2 | 8 | −0.6985 | −0.6831 | −0.6776 | −0.4465 | −0.4632 | −0.4730 | −1.0000 | −0.4465 | 0.0029 | −0.0013 |
| 8 6 A | 8 | −0.6993 | −0.6839 | −0.6776 | −0.4465 | −0.4632 | −0.4740 | −1.0000 | −0.4465 | 0.0029 | −0.0013 |
| 8 5 5 | 8 | −0.7107 | −0.6796 | −0.6796 | −0.4465 | −0.4669 | −0.4669 | −1.0000 | −0.4465 | 0.0011 | −0.0005 |
| 8 5 4 | 8 | −0.7012 | −0.6811 | −0.6798 | −0.4465 | −0.4677 | −0.4701 | −1.0000 | −0.4465 | 0.0029 | −0.0013 |
| 8 5 3 | 8 | −0.7023 | −0.6822 | −0.6798 | −0.4465 | −0.4677 | −0.4718 | −1.0000 | −0.4465 | 0.0029 | −0.0013 |
| 8 5 2 | 8 | −0.7032 | −0.6831 | −0.6798 | −0.4465 | −0.4677 | −0.4730 | −1.0000 | −0.4465 | 0.0029 | −0.0013 |
| 8 5 A | 8 | −0.7039 | −0.6839 | −0.6798 | −0.4465 | −0.4677 | −0.4740 | −1.0000 | −0.4465 | 0.0029 | −0.0013 |
| 8 4 4 | 8 | −0.7107 | −0.6812 | −0.6812 | −0.4465 | −0.4699 | −0.4699 | −1.0000 | −0.4465 | 0.0011 | −0.0005 |
| 8 4 3 | 8 | −0.7052 | −0.6822 | −0.6814 | −0.4465 | −0.4704 | −0.4718 | −1.0000 | −0.4465 | 0.0029 | −0.0013 |
| 8 4 2 | 8 | −0.7061 | −0.6831 | −0.6814 | −0.4465 | −0.4704 | −0.4729 | −1.0000 | −0.4465 | 0.0029 | −0.0013 |
| 8 4 A | 8 | −0.7069 | −0.6839 | −0.6814 | −0.4465 | −0.4704 | −0.4740 | −1.0000 | −0.4465 | 0.0029 | −0.0013 |
| 8 3 3 | 8 | −0.7107 | −0.6823 | −0.6823 | −0.4465 | −0.4717 | −0.4717 | −1.0000 | −0.4465 | 0.0011 | −0.0005 |
| 8 3 2 | 8 | −0.7078 | −0.6831 | −0.6824 | −0.4465 | −0.4720 | −0.4729 | −1.0000 | −0.4465 | 0.0029 | −0.0013 |
| 8 3 A | 8 | −0.7086 | −0.6839 | −0.6824 | −0.4465 | −0.4720 | −0.4740 | −1.0000 | −0.4465 | 0.0029 | −0.0013 |
| 8 2 2 | 8 | −0.7107 | −0.6832 | −0.6832 | −0.4465 | −0.4729 | −0.4729 | −1.0000 | −0.4465 | 0.0011 | −0.0005 |

TABLE 3-continued

Expected values of all ways to play all hands and optimal playing strategy.

| Hand | Optimal Holds | Discard 1st | Discard 2nd | Discard 3rd | Keep 1st | Keep 2nd | Keep 3rd | Keep All | Best EV | Probability | Return |
|---|---|---|---|---|---|---|---|---|---|---|---|
| 8 2 A | 8 | −0.7094 | −0.6839 | −0.6833 | −0.4465 | −0.4731 | −0.4740 | −1.0000 | −0.4465 | 0.0029 | −0.0013 |
| 8 A A | 8 | −0.7107 | −0.6839 | −0.6839 | −0.4465 | −0.4740 | −0.4740 | −1.0000 | −0.4465 | 0.0011 | −0.0005 |
| 7 7 7 | 7 | −0.7106 | −0.7106 | −0.7106 | −0.4525 | −0.4525 | −0.4525 | −1.0000 | −0.4525 | 0.0002 | −0.0001 |
| 7 7 6 | 7 | −0.6872 | −0.6872 | −0.7107 | −0.4552 | −0.4552 | −0.4619 | −1.0000 | −0.4552 | 0.0011 | −0.0005 |
| 7 7 5 | 7 | −0.6888 | −0.6888 | −0.7107 | −0.4552 | −0.4552 | −0.4669 | −1.0000 | −0.4552 | 0.0011 | −0.0005 |
| 7 7 4 | 7 | −0.6900 | −0.6900 | −0.7107 | −0.4552 | −0.4552 | −0.4699 | −1.0000 | −0.4552 | 0.0011 | −0.0005 |
| 7 7 3 | 7 | −0.6908 | −0.6908 | −0.7107 | −0.4552 | −0.4552 | −0.4717 | −1.0000 | −0.4552 | 0.0011 | −0.0005 |
| 7 7 2 | 7 | −0.6914 | −0.6914 | −0.7107 | −0.4552 | −0.4552 | −0.4729 | −1.0000 | −0.4552 | 0.0011 | −0.0005 |
| 7 7 A | 7 | −0.6919 | −0.6919 | −0.7107 | −0.4552 | −0.4552 | −0.4739 | −1.0000 | −0.4552 | 0.0011 | −0.0005 |
| 7 6 6 | 7 | −0.7107 | −0.6872 | −0.6872 | −0.4574 | −0.4618 | −0.4618 | −1.0000 | −0.4574 | 0.0011 | −0.0005 |
| 7 6 5 | 7 | −0.6948 | −0.6893 | −0.6875 | −0.4574 | −0.4632 | −0.4672 | −1.0000 | −0.4574 | 0.0029 | −0.0013 |
| 7 6 4 | 7 | −0.6965 | −0.6910 | −0.6875 | −0.4574 | −0.4632 | −0.4701 | −1.0000 | −0.4574 | 0.0029 | −0.0013 |
| 7 6 3 | 7 | −0.6977 | −0.6921 | −0.6875 | −0.4574 | −0.4632 | −0.4718 | −1.0000 | −0.4574 | 0.0029 | −0.0013 |
| 7 6 2 | 7 | −0.6985 | −0.6930 | −0.6875 | −0.4574 | −0.4632 | −0.4729 | −1.0000 | −0.4574 | 0.0029 | −0.0013 |
| 7 6 A | 7 | −0.6993 | −0.6938 | −0.6875 | −0.4574 | −0.4632 | −0.4740 | −1.0000 | −0.4574 | 0.0029 | −0.0013 |
| 7 5 5 | 7 | −0.7107 | −0.6895 | −0.6895 | −0.4574 | −0.4669 | −0.4669 | −1.0000 | −0.4574 | 0.0011 | −0.0005 |
| 7 5 4 | 7 | −0.7012 | −0.6910 | −0.6897 | −0.4574 | −0.4677 | −0.4701 | −1.0000 | −0.4574 | 0.0029 | −0.0013 |
| 7 5 3 | 7 | −0.7023 | −0.6921 | −0.6897 | −0.4574 | −0.4677 | −0.4718 | −1.0000 | −0.4574 | 0.0029 | −0.0013 |
| 7 5 2 | 7 | −0.7032 | −0.6930 | −0.6897 | −0.4574 | −0.4677 | −0.4729 | −1.0000 | −0.4574 | 0.0029 | −0.0013 |
| 7 5 A | 7 | −0.7039 | −0.6938 | −0.6897 | −0.4574 | −0.4677 | −0.4740 | −1.0000 | −0.4574 | 0.0029 | −0.0013 |
| 7 4 4 | 7 | −0.7107 | −0.6911 | −0.6911 | −0.4573 | −0.4699 | −0.4699 | −1.0000 | −0.4573 | 0.0011 | −0.0005 |
| 7 4 3 | 7 | −0.7052 | −0.6921 | −0.6913 | −0.4573 | −0.4704 | −0.4718 | −1.0000 | −0.4573 | 0.0029 | −0.0013 |
| 7 4 2 | 7 | −0.7061 | −0.6930 | −0.6913 | −0.4573 | −0.4704 | −0.4729 | −1.0000 | −0.4573 | 0.0029 | −0.0013 |
| 7 4 A | 7 | −0.7069 | −0.6938 | −0.6913 | −0.4573 | −0.4704 | −0.4739 | −1.0000 | −0.4573 | 0.0029 | −0.0013 |
| 7 3 3 | 7 | −0.7107 | −0.6922 | −0.6922 | −0.4573 | −0.4717 | −0.4717 | −1.0000 | −0.4573 | 0.0011 | −0.0005 |
| 7 3 2 | 7 | −0.7078 | −0.6930 | −0.6923 | −0.4573 | −0.4720 | −0.4729 | −1.0000 | −0.4573 | 0.0029 | −0.0013 |
| 7 3 A | 7 | −0.7086 | −0.6938 | −0.6923 | −0.4573 | −0.4720 | −0.4739 | −1.0000 | −0.4573 | 0.0029 | −0.0013 |
| 7 2 2 | 7 | −0.7107 | −0.6931 | −0.6931 | −0.4573 | −0.4729 | −0.4729 | −1.0000 | −0.4573 | 0.0011 | −0.0005 |
| 7 2 A | 7 | −0.7094 | −0.6938 | −0.6932 | −0.4573 | −0.4731 | −0.4739 | −1.0000 | −0.4573 | 0.0029 | −0.0013 |
| 7 A A | 7 | −0.7107 | −0.6938 | −0.6938 | −0.4573 | −0.4740 | −0.4740 | −1.0000 | −0.4573 | 0.0011 | −0.0005 |
| 6 6 6 | 6 | −0.7106 | −0.7106 | −0.7106 | −0.4612 | −0.4612 | −0.4612 | −1.0000 | −0.4612 | 0.0002 | −0.0001 |
| 6 6 5 | 6 | −0.6961 | −0.6961 | −0.7107 | −0.4628 | −0.4628 | −0.4669 | −1.0000 | −0.4628 | 0.0011 | −0.0005 |
| 6 6 4 | 6 | −0.6972 | −0.6972 | −0.7107 | −0.4628 | −0.4628 | −0.4699 | −1.0000 | −0.4628 | 0.0011 | −0.0005 |
| 6 6 3 | 6 | −0.6980 | −0.6980 | −0.7107 | −0.4628 | −0.4628 | −0.4717 | −1.0000 | −0.4628 | 0.0011 | −0.0005 |
| 6 6 2 | 6 | −0.6986 | −0.6986 | −0.7107 | −0.4628 | −0.4628 | −0.4728 | −1.0000 | −0.4628 | 0.0011 | −0.0005 |
| 6 6 A | 6 | −0.6991 | −0.6991 | −0.7107 | −0.4628 | −0.4628 | −0.4739 | −1.0000 | −0.4628 | 0.0011 | −0.0005 |
| 6 5 5 | 6 | −0.7107 | −0.6961 | −0.6961 | −0.4641 | −0.4669 | −0.4669 | −1.0000 | −0.4641 | 0.0011 | −0.0005 |
| 6 5 4 | 6 | −0.7012 | −0.6976 | −0.6963 | −0.4641 | −0.4677 | −0.4701 | −1.0000 | −0.4641 | 0.0029 | −0.0013 |
| 6 5 3 | 6 | −0.7023 | −0.6987 | −0.6963 | −0.4641 | −0.4677 | −0.4718 | −1.0000 | −0.4641 | 0.0029 | −0.0013 |
| 6 5 2 | 6 | −0.7032 | −0.6996 | −0.6963 | −0.4641 | −0.4677 | −0.4729 | −1.0000 | −0.4641 | 0.0029 | −0.0013 |
| 6 5 A | 6 | −0.7039 | −0.7003 | −0.6963 | −0.4641 | −0.4677 | −0.4739 | −1.0000 | −0.4641 | 0.0029 | −0.0013 |
| 6 4 4 | 6 | −0.7107 | −0.6977 | −0.6977 | −0.4641 | −0.4699 | −0.4699 | −1.0000 | −0.4641 | 0.0011 | −0.0005 |
| 6 4 3 | 6 | −0.7052 | −0.6987 | −0.6978 | −0.4641 | −0.4704 | −0.4718 | −1.0000 | −0.4641 | 0.0029 | −0.0013 |
| 6 4 2 | 6 | −0.7061 | −0.6996 | −0.6978 | −0.4641 | −0.4704 | −0.4729 | −1.0000 | −0.4641 | 0.0029 | −0.0013 |
| 6 4 A | 6 | −0.7069 | −0.7003 | −0.6978 | −0.4640 | −0.4703 | −0.4739 | −1.0000 | −0.4640 | 0.0029 | −0.0013 |
| 6 3 3 | 6 | −0.7107 | −0.6988 | −0.6988 | −0.4640 | −0.4717 | −0.4717 | −1.0000 | −0.4640 | 0.0011 | −0.0005 |
| 6 3 2 | 6 | −0.7078 | −0.6996 | −0.6989 | −0.4640 | −0.4720 | −0.4729 | −1.0000 | −0.4640 | 0.0029 | −0.0013 |
| 6 3 A | 6 | −0.7086 | −0.7003 | −0.6989 | −0.4640 | −0.4720 | −0.4739 | −1.0000 | −0.4640 | 0.0029 | −0.0013 |
| 6 2 2 | 6 | −0.7107 | −0.6996 | −0.6996 | −0.4640 | −0.4729 | −0.4729 | −1.0000 | −0.4640 | 0.0011 | −0.0005 |
| 6 2 A | 6 | −0.7094 | −0.7003 | −0.6997 | −0.4640 | −0.4731 | −0.4739 | −1.0000 | −0.4640 | 0.0029 | −0.0013 |
| 6 A A | 6 | −0.7107 | −0.7004 | −0.7004 | −0.4640 | −0.4740 | −0.4740 | −1.0000 | −0.4640 | 0.0011 | −0.0005 |
| 5 5 5 | 5 | −0.7106 | −0.7106 | −0.7106 | −0.4665 | −0.4665 | −0.4665 | −1.0000 | −0.4665 | 0.0002 | −0.0001 |
| 5 5 4 | 5 | −0.7019 | −0.7019 | −0.7107 | −0.4674 | −0.4674 | −0.4699 | −1.0000 | −0.4674 | 0.0011 | −0.0005 |
| 5 5 3 | 5 | −0.7027 | −0.7027 | −0.7107 | −0.4674 | −0.4674 | −0.4717 | −1.0000 | −0.4674 | 0.0011 | −0.0005 |
| 5 5 2 | 5 | −0.7033 | −0.7033 | −0.7107 | −0.4674 | −0.4674 | −0.4728 | −1.0000 | −0.4674 | 0.0011 | −0.0005 |
| 5 5 A | 5 | −0.7038 | −0.7038 | −0.7107 | −0.4674 | −0.4674 | −0.4739 | −1.0000 | −0.4674 | 0.0011 | −0.0005 |
| 5 4 4 | 5 | −0.7107 | −0.7019 | −0.7019 | −0.4682 | −0.4699 | −0.4699 | −1.0000 | −0.4682 | 0.0011 | −0.0005 |
| 5 4 3 | 5 | −0.7052 | −0.7030 | −0.7021 | −0.4682 | −0.4703 | −0.4718 | −1.0000 | −0.4682 | 0.0029 | −0.0014 |
| 5 4 2 | 5 | −0.7061 | −0.7038 | −0.7021 | −0.4682 | −0.4703 | −0.4729 | −1.0000 | −0.4682 | 0.0029 | −0.0014 |
| 5 4 A | 5 | −0.7069 | −0.7046 | −0.7021 | −0.4681 | −0.4703 | −0.4739 | −1.0000 | −0.4681 | 0.0029 | −0.0014 |
| 5 3 3 | 5 | −0.7107 | −0.7030 | −0.7030 | −0.4681 | −0.4717 | −0.4717 | −1.0000 | −0.4681 | 0.0011 | −0.0005 |
| 5 3 2 | 5 | −0.7078 | −0.7038 | −0.7031 | −0.4681 | −0.4720 | −0.4729 | −1.0000 | −0.4681 | 0.0029 | −0.0014 |
| 5 3 A | 5 | −0.7086 | −0.7046 | −0.7031 | −0.4681 | −0.4720 | −0.4739 | −1.0000 | −0.4681 | 0.0029 | −0.0014 |
| 5 2 2 | 5 | −0.7107 | −0.7039 | −0.7039 | −0.4681 | −0.4729 | −0.4729 | −1.0000 | −0.4681 | 0.0011 | −0.0005 |
| 5 2 A | 5 | −0.7094 | −0.7046 | −0.7040 | −0.4681 | −0.4731 | −0.4739 | −1.0000 | −0.4681 | 0.0029 | −0.0014 |
| 5 A A | 5 | −0.7107 | −0.7047 | −0.7047 | −0.4681 | −0.4740 | −0.4740 | −1.0000 | −0.4681 | 0.0011 | −0.0005 |
| 4 4 4 | 4 | −0.7106 | −0.7106 | −0.7106 | −0.4697 | −0.4697 | −0.4697 | −1.0000 | −0.4697 | 0.0002 | −0.0001 |
| 4 4 3 | 4 | −0.7057 | −0.7057 | −0.7107 | −0.4702 | −0.4702 | −0.4717 | −1.0000 | −0.4702 | 0.0011 | −0.0005 |
| 4 4 2 | 4 | −0.7063 | −0.7063 | −0.7107 | −0.4702 | −0.4702 | −0.4728 | −1.0000 | −0.4702 | 0.0011 | −0.0005 |
| 4 4 A | 4 | −0.7068 | −0.7068 | −0.7107 | −0.4702 | −0.4702 | −0.4739 | −1.0000 | −0.4702 | 0.0011 | −0.0005 |
| 4 3 3 | 4 | −0.7107 | −0.7057 | −0.7057 | −0.4706 | −0.4717 | −0.4717 | −1.0000 | −0.4706 | 0.0011 | −0.0005 |
| 4 3 2 | 4 | −0.7078 | −0.7065 | −0.7058 | −0.4706 | −0.4720 | −0.4729 | −1.0000 | −0.4706 | 0.0029 | −0.0014 |
| 4 3 A | 4 | −0.7086 | −0.7072 | −0.7058 | −0.4706 | −0.4720 | −0.4739 | −1.0000 | −0.4706 | 0.0029 | −0.0014 |
| 4 3 A | 4 | −0.7086 | −0.7072 | −0.7058 | −0.4706 | −0.4720 | −0.4739 | −1.0000 | −0.4706 | 0.0029 | −0.0014 |

TABLE 3-continued

Expected values of all ways to play all hands and optimal playing strategy.

| Hand | Optimal Holds | Discard 1st | Discard 2nd | Discard 3rd | Keep 1st | Keep 2nd | Keep 3rd | Keep All | Best EV | Probability | Return |
|---|---|---|---|---|---|---|---|---|---|---|---|
| 4 2 2 | 4 | −0.7107 | −0.7065 | −0.7065 | −0.4706 | −0.4729 | −0.4729 | −1.0000 | −0.4706 | 0.0011 | −0.0005 |
| 4 2 A | 4 | −0.7094 | −0.7072 | −0.7066 | −0.4706 | −0.4731 | −0.4739 | −1.0000 | −0.4706 | 0.0029 | −0.0014 |
| 4 A A | 4 | −0.7107 | −0.7073 | −0.7073 | −0.4706 | −0.4740 | −0.4740 | −1.0000 | −0.4706 | 0.0011 | −0.0005 |
| 3 3 3 | 3 | −0.7106 | −0.7106 | −0.7106 | −0.4716 | −0.4716 | −0.4716 | −1.0000 | −0.4716 | 0.0002 | −0.0001 |
| 3 3 2 | 3 | −0.7081 | −0.7081 | −0.7107 | −0.4719 | −0.4719 | −0.4728 | −1.0000 | −0.4719 | 0.0011 | −0.0005 |
| 3 3 A | 3 | −0.7086 | −0.7086 | −0.7107 | −0.4719 | −0.4719 | −0.4739 | −1.0000 | −0.4719 | 0.0011 | −0.0005 |
| 3 2 2 | 3 | −0.7107 | −0.7081 | −0.7081 | −0.4721 | −0.4729 | −0.4729 | −1.0000 | −0.4721 | 0.0011 | −0.0005 |
| 3 2 A | 3 | −0.7094 | −0.7088 | −0.7082 | −0.4721 | −0.4730 | −0.4739 | −1.0000 | −0.4721 | 0.0029 | −0.0014 |
| 3 A A | 3 | −0.7107 | −0.7089 | −0.7089 | −0.4721 | −0.4740 | −0.4740 | −1.0000 | −0.4721 | 0.0011 | −0.0005 |
| 2 2 2 | 2 | −0.7106 | −0.7106 | −0.7106 | −0.4728 | −0.4728 | −0.4728 | −1.0000 | −0.4728 | 0.0002 | −0.0001 |
| 2 2 A | 2 | −0.7094 | −0.7094 | −0.7107 | −0.4730 | −0.4730 | −0.4739 | −1.0000 | −0.4730 | 0.0011 | −0.0005 |
| 2 A A | 2 | −0.7107 | −0.7094 | −0.7094 | −0.4732 | −0.4740 | −0.4740 | −1.0000 | −0.4732 | 0.0011 | −0.0005 |
| A A A | A | −0.7106 | −0.7106 | −0.7106 | −0.4740 | −0.4740 | −0.4740 | −1.0000 | −0.4740 | 0.0002 | −0.0001 |
| | | | | | | | | | | 1.0000 | −0.0153 |

21+ Side Bet—Rules/Analysis

The 21+ bet is a side bet that pays for certain combinations of the player's first 3 cards. To win, a player needs 3 dealt cards that contain at least 2 high cards and no pairs. The following table shows the different hands on the pay schedule and the house advantage of the bet.

TABLE 2

21 + side bet house advantage summary.

| Hand | Pays | Combinations | Probability | Frequency | Return |
|---|---|---|---|---|---|
| Three (Non-pairing) High Cards | 20 to 1 | 256 | 0.011584 | 1 in 86.3 | 0.231674 |
| Two High (Non-Pairing) Cards + 7, 8 or 9 | 5 | 1152 | 0.052127 | 1 in 19.2 | 0.260633 |
| Two High Cards + A, 2, 3, 4, 5, or 6 | 3 | 2304 | 0.104253 | 1 in 9.6 | 0.312760 |
| Other | −1 | 18,388 | 0.832036 | 1 in 1.2 | −0.832036 |
| Total | | 22,100 | 1.000000 | | −0.026968 |
| | | | | House Advantage | 2.6968% |

Appendix A

The following table gives the expected values of all ways to play any dealt hand and shows the optimal playing strategy. Note: Although the table shows the value of keeping all 3 original cards for all hands, in most cases, this is not a valid option.

Table 3: Expected values of all ways to play all hands and optimal playing strategy.

EXAMPLES

The following examples are used to illustrate play of the game, with the suit of playing cards not being indicated as the suits have no bearing on the play of the basic game of 3-Card Draw™ casino game.

Example 1

A game with three players and a dealer will be reviewed. Players 1 and 2 wager a $10.00 Ante wager each, and Player 3 makes a $25 Ante wager and a $5 21 Plus™ wager. The players dealt hands are as follows:

| Player 1 | Player 2 | Player 3 |
|---|---|---|
| 2 7 10 | 6 Q K | 7 9 10 |

Player 1 does not have a dealt qualified hand, and would elect to replace the 2 by discarding it. It is a possible option in the play of the game that when a player discards, a second or Play wager may be made. In this version of the game, no such option exists, so the player discards the 2 and receives a Jack.

Player 2 likewise does not have a dealt qualified hand, even though the hand is otherwise quite good. The player would likely not discard (if discarding is not automatic) or discard the 6. The decision to not discard would be based on the fact that K Q is a high hand, and the hand would be improved with only a 7, 8, 9, 10 or J, only a 40% probability; while the hand would be devalued with any other cards. In this example, the Player 2 elects to take a hit and receives a Q. This reduces the Player 2's 3 Card Draw™ game hand to a single King.

Player 3 has no dealt qualified hand and loses the 21 Plus™ wager. Player 3 could discard 1 or 2 cards and chooses to discard the 7 and 9. The player receives an Ace and Jack, to provide a final hand of A-J-10.

The dealer's initial five cards are revealed as:

| Ace, 4, 7, 10, Jack |
|---|

According to various house rules, the dealer hand may be allowed to discard zero, one, two or three cards. This game will be played by way of example with the dealer allowed to discard a maximum of two cards, discarding the Ace and 4, receiving a Queen and 7 as replacement cards. This leaves the dealer with a hand of Q J 10, the 7s being discarded as a Pair.

Against this dealer hand, Player 1 loses, Player 2 (even though a single card hand of a King) wins the Ante bet at 1:1 odds, and Player 3 loses.

Example 2

A game with three players and a dealer will be reviewed. Players 1 and 2 wager a $10.00 Ante wager each, and Player 3 makes a $25 Ante wager and a $5 21 Plus™ wager. The players dealt hands are as follows:

| Player 1 | Player 2 | Player 3 |
|---|---|---|
| 10 10 J | 6 10 Q | 10 J Q |

Player 2 doesn't have a qualifying hand. Player 3 has a dealt qualifying hand and has a hand that wins on the 21 Plus™ side bet. Player 1 effectively has a single card hand of a Jack. Player 1 would discard or be required to discard one 10 (although in some rule variants, the player may be required to discard both cards of a Pair to receive any replacement cards). Player 1 receives a 7 for the discarded 10. Player 2 discards the 6 and receives a 4. Player 3 stands with the 10 J Q hand.

The dealer's five card hand is:

| Ace, 4, 6, 8, King |
|---|

It does not matter what the dealer does, with the single King, the dealer's hand beats all three of the players' hands. Only Player 3 is paid for the 21 Plus wager, having been dealt three initial high cards, receiving a 20:1 payout or $100.00 on the $5.00 wager. It is to be noted that the Player 3 hand is not a poker rank, but is ranked card by card, highest card first against the dealer's hand, without consideration of the suit or pairs or straights. The King may be considered a 13 value card, and by having the highest value card versus the player's highest value card, the dealer wins with the 13 value card. Any other card may be designated the highest value card, and one or more jokers may be provided to the set of cards as the highest value cards, such as a 14 count card. Special game events may be associated with the Joker such as excluding a win on the 21 Plus wager (since with a single Joker in the deck, a win is guaranteed for the player), or that the presence of the Joker in the dealer's hand is an automatic push or an automatic loss, or the Joker in the player's hand is an automatic push or an automatic loss.

The following table summarizes these results. See Appendix A for complete analysis details and the optimal playing strategy.

TABLE 1

House advantage summary.

| Event | Pays | Probability | Frequency | Return |
|---|---|---|---|---|
| Final Hand 9 High or Less | −1 | 0.189800 | 1 in 5.3 | −0.189800 |
| Wins | 1 | 0.491046 | 1 in 2.0 | 0.491046 |
| Ties | 0 | 0.002592 | 1 in 385.8 | 0.000000 |
| Losses | −1 | 0.316562 | 1 in 3.2 | −0.316562 |
| Total | | 1.000000 | | −0.015316 |
| | | | House Advantage | 1.5316% |

The technology of the present system therefore includes a method of playing a wagering game comprising: at least one player placing an Ante wager to compete against a dealer in a playing card game; the at least one player receiving a player initial hand of multiple cards of number n and evaluating the playing cards according to rules comprising:

a) the player automatically losing the Ante wager if no card in the player resulting hand has a value above a minimum value;

b) the player having the option of retaining all cards in the player initial hand or replacing one or more cards in the player initial hand if at least one card in the player's hand equals or exceeds the minimum value to form a player resulting hand;

the dealer may receive a dealer initial hand having more than n cards, the dealer replacing one or more cards in the dealer initial hand if at least one card in the dealer initial hand equals or exceeds the minimum value to form a dealer resulting hand; and the dealer comparing a single highest value card in the resulting dealer hand with a single highest value card in the player resulting hand as an at least initial step in determining a win loss event for the Ante wager. The number n is at least 2, at least 3 or n is 3. The dealer initial hand is at least 4 cards, at least five cards or exactly 5 cards. The minimum value is a value of 9, 10 or 11 or a Jack. The method preferably uses a minimum value of 10 from a standard deck of 52 playing cards. The method may use a minimum value of 10 from a standard deck of 52 playing cards with at least one joker or specialty card in addition to the 52 cards. The method may include a rule that any pairs in the dealer initial hand, the player initial hand, the dealer resulting hand and the player resulting hand are automatically removed from consideration in determining a single value highest card in any player hand and any dealer hand. The method may include a rule wherein if a first single highest value card in the player's resulting hand and a first single highest value card in the dealer resulting hand are equal, a second single highest card in the dealer hand is compared with a second single highest card in the player hand as an at least second step in determining a win loss event for the Ante wager. The method may include a rule wherein if the second single highest value card in the player's resulting hand and the second single highest value card in the dealer resulting hand are equal, a third single highest card in the dealer hand is compared with a third single highest card in the player hand as an at least third step in determining a win loss event for the Ante wager. The method may include a rule wherein if after single cards are compared and found to be equal and any player resulting hand or dealer resulting hand has no more cards for comparison, any respective dealer resulting hand or player resulting hand with at least another card available for comparison wins the Ante wager. The method with a rule wherein if after single cards are compared and found to be equal and any player resulting hand or dealer resulting hand has no more cards for comparison, any respective dealer resulting hand or player resulting hand with at least another card available for comparison wins the Ante wager. The method including a side bet placed by the player that is resolved in the player's favor if the player initial hand has at least two cards that equal or exceed the minimum value. The game is preferably played as a live casino table card game, but may be played on electronic media such as video slots or table slot-type machines, hybrid (mixed live and electronic media) or on the internet. Other variations within the scope of the teachings of the present technology are also included in the scope of this disclosure.

What is claimed:

1. A method of playing a wagering game stored on a non-transitory computer readable medium executed by a processor performing the steps comprising:

at least one player placing an Ante wager to compete against a dealer in a playing card game;

the at least one player receiving a player initial hand of multiple cards of number n and evaluating the playing cards according to rules executed by said processor comprising:

a) the player automatically losing the Ante wager if no card in the player initial hand has a value above a minimum value;

b) the player having the option of retaining all cards in the player initial hand or replacing one or more cards in the player initial hand if at least one card in the player initial hand equals or exceeds the minimum value to form a player resulting hand;

c) the dealer receiving a dealer initial hand having more than n cards, the dealer replacing one or more cards in the dealer initial hand if at least one card in the dealer initial hand equals or exceeds the minimum value to form a dealer resulting hand; and d) the dealer comparing a single highest value card in the resulting dealer hand with a single highest value card in the player resulting hand as an at least initial step in determining a win loss event for the Ante wager.

2. The method of claim 1 wherein n is at least 2.

3. The method of claim 1 wherein n is at least 3.

4. The method of claim 1 wherein n is 3.

5. The method of claim 4 wherein the dealer initial hand is at least 4.

6. The method of claim 5 wherein the dealer initial hand is 5.

7. The method of claim 6 wherein the minimum value is a value of 10.

8. The method of claim 7 wherein if a first single highest value card in the player's resulting hand and a first single highest value card in the dealer resulting hand are equal, a second single highest card in the dealer hand is compared with a second single highest card in the player hand as an at least second step in determining a win loss event for the Ante wager.

9. The method of claim 6 wherein the minimum value is a value of 10 from a standard deck of 52 playing cards.

10. The method of claim 9 wherein if a first single highest value card in the player's resulting hand and a first single highest value card in the dealer resulting hand are equal, a second single highest card in the dealer hand is compared with a second single highest card in the player hand as an at least second step in determining a win loss event for the Ante wager.

11. The method of claim 9 wherein if after single cards are compared and found to be equal and any player resulting hand or dealer resulting hand has no more cards for comparison, any respective dealer resulting hand or player resulting hand with at least another card available for comparison wins the Ante wager.

12. The method of claim 6 wherein the minimum value is a value of 10 from a standard deck of 52 playing cards with at least one joker or specialty card in addition to the 52 cards.

13. The method of claim 12 in which any pairs in the dealer initial hand, the player initial hand, the dealer resulting hand and the player resulting hand are automatically removed from consideration in determining a single value highest card in any player hand and any dealer hand.

14. The method of claim 13 wherein if a first single highest value card in the player's resulting hand and a first single highest value card in the dealer resulting hand are equal, a second single highest card in the dealer hand is compared with a second single highest card in the player hand as an at least second step in determining a win loss event for the Ante wager.

15. The method of claim 14 wherein if the second single highest value card in the player's resulting hand and the second single highest value card in the dealer resulting hand are equal, a third single highest card in the dealer hand is compared with a third single highest card in the player hand as an at least third step in determining a win loss event for the Ante wager.

16. The method of claim 15 wherein if after single cards are compared and found to be equal and any player resulting hand or dealer resulting hand has no more cards for comparison, any respective dealer resulting hand or player resulting hand with at least another card available for comparison wins the Ante wager.

17. The method of claim 12 wherein if a first single highest value card in the player's resulting hand and a first single highest value card in the dealer resulting hand are equal, a second single highest card in the dealer hand is compared with a second single highest card in the player hand as an at least second step in determining a win loss event for the Ante wager.

18. The method of claim 17 wherein if the second single highest value card in the player's resulting hand and the second single highest value card in the dealer resulting hand are equal, a third single highest card in the dealer hand is compared with a third single highest card in the player hand as an at least third step in determining a win loss event for the Ante wager.

19. The method of claim 17 wherein if after single cards are compared and found to be equal and any player resulting hand or dealer resulting hand has no more cards for comparison, any respective dealer resulting hand or player resulting hand with at least another card available for comparison wins the Ante wager.

20. The method of claim 1 wherein a side bet is placed by the player that is resolved in the player's favor if the player initial hand has at least two cards that equal or exceed the minimum value.

* * * * *